US008295523B2

(12) United States Patent
Fay et al.

(10) Patent No.: US 8,295,523 B2
(45) Date of Patent: Oct. 23, 2012

(54) ENERGY DELIVERY AND MICROPHONE PLACEMENT METHODS FOR IMPROVED COMFORT IN AN OPEN CANAL HEARING AID

(75) Inventors: Jonathan P. Fay, San Mateo, CA (US); Sunil Puria, Sunnyvale, CA (US); Paul Rucker, San Francisco, CA (US); John H. Winstead, Bend, OR (US); Rodney C. Perkins, Woodside, CA (US)

(73) Assignee: Soundbeam LLC, Redwood City, CA (US)

( * ) Notice: Subject to any disclaimer, the term of this patent is extended or adjusted under 35 U.S.C. 154(b) by 917 days.

(21) Appl. No.: 12/244,266

(22) Filed: Oct. 2, 2008

(65) Prior Publication Data

US 2009/0092271 A1 Apr. 9, 2009

Related U.S. Application Data

(60) Provisional application No. 60/977,605, filed on Oct. 4, 2007.

(51) Int. Cl.
*H04R 25/00* (2006.01)

(52) U.S. Cl. ..... 381/328; 381/324; 381/330

(58) Field of Classification Search ..... 381/322, 381/324, 328, 330
See application file for complete search history.

(56) References Cited

U.S. PATENT DOCUMENTS 3,440,314 A 4/1969 Frisch
3,549,818 A 12/1970 Turner et al.
3,585,416 A 6/1971 Mellen
3,594,514 A 7/1971 Wingrove
3,710,399 A 1/1973 Hurst
3,712,962 A 1/1973 Epley
3,764,748 A 10/1973 Branch et al.
3,808,179 A 4/1974 Gaylord
3,882,285 A 5/1975 Nunley et al.

(Continued)

FOREIGN PATENT DOCUMENTS

AU 2004-301961 2/2005

(Continued)

OTHER PUBLICATIONS

International Search Report and Written Opinion of PCT Application No. PCT/US08/78793, dated Dec. 8, 2008; 12 pages total.

(Continued)

*Primary Examiner* — Matthew E Warren
(74) *Attorney, Agent, or Firm* — Wilson, Sonsini, Goodrich & Rosati

(57) ABSTRACT

A hearing aid device for placement in an ear of a user includes an elongate support and a transducer. The elongate support has a proximal portion and a distal end, and the transducer is attached to the elongate support near the distal end. The support is adapted to position the transducer near an eardrum while the proximal portion is placed at the location near an ear canal opening. The elongate support is sized to minimize contact with the ear between the proximal portion and distal end. The elongate support permits sound waves to travel along the ear canal. In some embodiments, a microphone is positioned in the ear canal along the support, for example inside the support, to provide directionally dependent sound localization cues, and the transducer on the distal end of the elongate support comprises a coil assembly coupled to a magnet positioned on the tympanic membrane.

23 Claims, 17 Drawing Sheets

U.S. PATENT DOCUMENTS

| | | | |
|---|---|---|---|
| 3,985,977 | A | 10/1976 | Beaty et al. |
| 4,002,897 | A | 1/1977 | Kleinman et al. |
| 4,061,972 | A | 12/1977 | Burgess |
| 4,075,042 | A | 2/1978 | Das |
| 4,098,277 | A | 7/1978 | Mendell |
| 4,120,570 | A | 10/1978 | Gaylord |
| 4,248,899 | A | 2/1981 | Lyon et al. |
| 4,252,440 | A | 2/1981 | Frosch et al. |
| 4,303,772 | A | 12/1981 | Novicky |
| 4,319,359 | A | 3/1982 | Wolf |
| 4,334,315 | A | 6/1982 | Ono et al. |
| 4,334,321 | A | 6/1982 | Edelman |
| 4,357,497 | A | 11/1982 | Hochmair et al. |
| 4,380,689 | A | 4/1983 | Giannetti |
| 4,428,377 | A | 1/1984 | Zollner et al. |
| 4,524,294 | A | 6/1985 | Brody |
| 4,540,761 | A | 9/1985 | Kawamura et al. |
| 4,556,122 | A | 12/1985 | Goode |
| 4,592,087 | A | 5/1986 | Killion |
| 4,606,329 | A | 8/1986 | Hough |
| 4,611,598 | A | 9/1986 | Hortmann et al. |
| 4,628,907 | A | 12/1986 | Epley |
| 4,641,377 | A | 2/1987 | Rush et al. |
| 4,689,819 | A | 8/1987 | Killion |
| 4,696,287 | A | 9/1987 | Hortmann et al. |
| 4,729,366 | A | 3/1988 | Schaefer |
| 4,741,339 | A | 5/1988 | Harrison et al. |
| 4,742,499 | A | 5/1988 | Butler |
| 4,756,312 | A | 7/1988 | Epley |
| 4,766,607 | A | 8/1988 | Feldman |
| 4,774,933 | A | 10/1988 | Hough et al. |
| 4,776,322 | A | 10/1988 | Hough et al. |
| 4,800,884 | A | 1/1989 | Heide et al. |
| 4,817,607 | A | 4/1989 | Tatge |
| 4,840,178 | A | 6/1989 | Heide et al. |
| 4,845,755 | A | 7/1989 | Busch et al. |
| 4,932,405 | A | 6/1990 | Peeters et al. |
| 4,936,305 | A | 6/1990 | Ashtiani et al. |
| 4,944,301 | A | 7/1990 | Widin et al. |
| 4,948,855 | A | 8/1990 | Novicky |
| 4,957,478 | A | 9/1990 | Maniglia |
| 4,999,819 | A | 3/1991 | Newnham et al. |
| 5,003,608 | A | 3/1991 | Carlson |
| 5,012,520 | A | 4/1991 | Steeger |
| 5,015,224 | A | 5/1991 | Mariglia |
| 5,015,225 | A | 5/1991 | Hough et al. |
| 5,031,219 | A | 7/1991 | Ward et al. |
| 5,061,282 | A | 10/1991 | Jacobs |
| 5,066,091 | A | 11/1991 | Stoy et al. |
| 5,094,108 | A | 3/1992 | Kim et al. |
| 5,117,461 | A | 5/1992 | Moseley |
| 5,142,186 | A | 8/1992 | Cross et al. |
| 5,163,957 | A | 11/1992 | Sade et al. |
| 5,167,235 | A | 12/1992 | Seacord et al. |
| 5,201,007 | A | 4/1993 | Ward et al. |
| 5,259,032 | A | 11/1993 | Perkins et al. |
| 5,272,757 | A | 12/1993 | Scofield et al. |
| 5,276,910 | A | 1/1994 | Buchele |
| 5,277,694 | A | 1/1994 | Leysieffer et al. |
| 5,402,496 | A | 3/1995 | Soli et al. |
| 5,411,467 | A | 5/1995 | Hortmann et al. |
| 5,425,104 | A | 6/1995 | Shennib |
| 5,440,082 | A | 8/1995 | Claes |
| 5,440,237 | A | 8/1995 | Brown et al. |
| 5,455,994 | A | 10/1995 | Termeer et al. |
| 5,456,654 | A | 10/1995 | Ball |
| 5,531,787 | A | 7/1996 | Lesinski et al. |
| 5,531,954 | A | 7/1996 | Heide et al. |
| 5,554,096 | A | 9/1996 | Ball |
| 5,558,618 | A | 9/1996 | Maniglia |
| 5,606,621 | A | 2/1997 | Reiter et al. |
| 5,624,376 | A | 4/1997 | Ball et al. |
| 5,707,338 | A | 1/1998 | Adams et al. |
| 5,721,783 | A | 2/1998 | Anderson |
| 5,729,077 | A | 3/1998 | Newnham et al. |
| 5,740,258 | A | 4/1998 | Goodwin-Johansson |
| 5,762,583 | A | 6/1998 | Adams et al. |
| 5,772,575 | A | 6/1998 | Lesinski et al. |
| 5,774,259 | A | 6/1998 | Saitoh et al. |
| 5,782,744 | A | 7/1998 | Money |
| 5,788,711 | A | 8/1998 | Lehner et al. |
| 5,795,287 | A | 8/1998 | Ball et al. |
| 5,797,834 | A | 8/1998 | Goode |
| 5,800,336 | A | 9/1998 | Ball et al. |
| 5,804,109 | A | 9/1998 | Perkins |
| 5,804,907 | A | 9/1998 | Park et al. |
| 5,814,095 | A | 9/1998 | Muller et al. |
| 5,825,122 | A | 10/1998 | Givargizov et al. |
| 5,836,863 | A | 11/1998 | Bushek et al. |
| 5,842,967 | A | 12/1998 | Kroll |
| 5,857,958 | A | 1/1999 | Ball et al. |
| 5,859,916 | A | 1/1999 | Ball et al. |
| 5,879,283 | A | 3/1999 | Adams et al. |
| 5,888,187 | A | 3/1999 | Jaeger et al. |
| 5,897,486 | A | 4/1999 | Ball et al. |
| 5,899,847 | A | 5/1999 | Adams et al. |
| 5,900,274 | A | 5/1999 | Chatterjee et al. |
| 5,906,635 | A | 5/1999 | Maniglia |
| 5,913,815 | A | 6/1999 | Ball et al. |
| 5,940,519 | A | 8/1999 | Kuo |
| 5,949,895 | A | 9/1999 | Ball et al. |
| 5,987,146 | A | 11/1999 | Pluvinage et al. |
| 6,005,955 | A | 12/1999 | Kroll et al. |
| 6,024,717 | A | 2/2000 | Ball et al. |
| 6,045,528 | A | 4/2000 | Arenberg et al. |
| 6,050,933 | A | 4/2000 | Bushek et al. |
| 6,068,589 | A | 5/2000 | Neukermans |
| 6,068,590 | A | 5/2000 | Brisken |
| 6,084,975 | A | 7/2000 | Perkins et al. |
| 6,093,144 | A | 7/2000 | Jaeger et al. |
| 6,137,889 | A | 10/2000 | Shennib et al. |
| 6,139,488 | A | 10/2000 | Ball |
| 6,153,966 | A | 11/2000 | Neukermans |
| 6,174,278 | B1 | 1/2001 | Jaeger et al. |
| 6,181,801 | B1 | 1/2001 | Puthuff et al. |
| 6,190,305 | B1 | 2/2001 | Ball et al. |
| 6,190,306 | B1 | 2/2001 | Kennedy |
| 6,208,445 | B1 | 3/2001 | Reime |
| 6,217,508 | B1 | 4/2001 | Ball et al. |
| 6,222,302 | B1 | 4/2001 | Imada et al. |
| 6,222,927 | B1 | 4/2001 | Feng et al. |
| 6,240,192 | B1 | 5/2001 | Brennan et al. |
| 6,241,767 | B1 | 6/2001 | Stennert et al. |
| 6,261,224 | B1 | 7/2001 | Adams et al. |
| 6,277,148 | B1 | 8/2001 | Dormer |
| 6,312,959 | B1 | 11/2001 | Datskos |
| 6,339,648 | B1 | 1/2002 | McIntosh et al. |
| 6,354,990 | B1 | 3/2002 | Juneau et al. |
| 6,366,863 | B1 | 4/2002 | Bye et al. |
| 6,385,363 | B1 | 5/2002 | Rajic et al. |
| 6,387,039 | B1 | 5/2002 | Moses |
| 6,393,130 | B1 | 5/2002 | Stonikas et al. |
| 6,422,991 | B1 | 7/2002 | Jaeger |
| 6,432,248 | B1 | 8/2002 | Popp et al. |
| 6,436,028 | B1 | 8/2002 | Dormer |
| 6,438,244 | B1 | 8/2002 | Juneau et al. |
| 6,445,799 | B1 | 9/2002 | Taenzer et al. |
| 6,473,512 | B1 | 10/2002 | Juneau et al. |
| 6,475,134 | B1 | 11/2002 | Ball et al. |
| 6,493,454 | B1 | 12/2002 | Loi et al. |
| 6,519,376 | B2 | 2/2003 | Biagi et al. |
| 6,536,530 | B2 | 3/2003 | Schultz et al. |
| 6,537,200 | B2 | 3/2003 | Leysieffer et al. |
| 6,549,633 | B1 | 4/2003 | Westermann |
| 6,554,761 | B1 | 4/2003 | Puria et al. |
| 6,592,513 | B1 | 7/2003 | Kroll et al. |
| 6,603,860 | B1 | 8/2003 | Taenzer et al. |
| 6,620,110 | B2 | 9/2003 | Schmid |
| 6,626,822 | B1 | 9/2003 | Jaeger et al. |
| 6,629,922 | B1 | 10/2003 | Puria et al. |
| 6,668,062 | B1 | 12/2003 | Luo et al. |
| 6,676,592 | B2 | 1/2004 | Ball et al. |
| 6,695,943 | B2 | 2/2004 | Juneau et al. |
| 6,724,902 | B1 | 4/2004 | Shennib et al. |
| 6,728,024 | B2 | 4/2004 | Ribak |
| 6,735,318 | B2 | 5/2004 | Cho |
| 6,754,358 | B1 | 6/2004 | Boeson et al. |

| | | | | |
|---|---|---|---|---|
| 6,801,629 | B2 | 10/2004 | Brimhall et al. | |
| 6,829,363 | B2 | 12/2004 | Sacha | |
| 6,842,647 | B1 | 1/2005 | Griffith et al. | |
| 6,888,949 | B1 | 5/2005 | Vanden Berghe et al. | |
| 6,900,926 | B2 | 5/2005 | Ribak | |
| 6,912,289 | B2 | 6/2005 | Vonlanthen et al. | |
| 6,920,340 | B2 | 7/2005 | Laderman | |
| 6,940,989 | B1 * | 9/2005 | Shennib et al. | 381/326 |
| D512,979 | S | 12/2005 | Corcoran et al. | |
| 6,978,159 | B2 | 12/2005 | Feng et al. | |
| 7,043,037 | B2 | 5/2006 | Lichtblau | |
| 7,072,475 | B1 | 7/2006 | DeNap et al. | |
| 7,076,076 | B2 | 7/2006 | Bauman | |
| 7,095,981 | B1 | 8/2006 | Voroba et al. | |
| 7,167,572 | B1 | 1/2007 | Harrison et al. | |
| 7,174,026 | B2 | 2/2007 | Niederdrank | |
| 7,203,331 | B2 | 4/2007 | Boesen | |
| 7,239,069 | B2 | 7/2007 | Cho | |
| 7,245,732 | B2 | 7/2007 | Jorgensen et al. | |
| 7,266,208 | B2 * | 9/2007 | Charvin et al. | 381/328 |
| 7,289,639 | B2 | 10/2007 | Abel et al. | |
| 7,322,930 | B2 | 1/2008 | Jaeger et al. | |
| 7,376,563 | B2 | 5/2008 | Leysieffer et al. | |
| 7,421,087 | B2 | 9/2008 | Perkins et al. | |
| 7,444,877 | B2 | 11/2008 | Li et al. | |
| 2001/0027342 | A1 | 10/2001 | Dormer | |
| 2002/0012438 | A1 | 1/2002 | Leysieffer et al. | |
| 2002/0030871 | A1 | 3/2002 | Anderson et al. | |
| 2002/0086715 | A1 | 7/2002 | Sahagen | |
| 2002/0172350 | A1 | 11/2002 | Edwards et al. | |
| 2002/0183587 | A1 | 12/2002 | Dormer | |
| 2003/0064746 | A1 | 4/2003 | Rader et al. | |
| 2003/0125602 | A1 | 7/2003 | Sokolich et al. | |
| 2003/0142841 | A1 | 7/2003 | Wiegand | |
| 2003/0208099 | A1 | 11/2003 | Ball | |
| 2004/0165742 | A1 | 8/2004 | Shennib et al. | |
| 2004/0208333 | A1 | 10/2004 | Cheung et al. | |
| 2004/0234089 | A1 | 11/2004 | Rembrand et al. | |
| 2004/0234092 | A1 | 11/2004 | Wada et al. | |
| 2004/0240691 | A1 | 12/2004 | Grafenberg | |
| 2005/0020873 | A1 | 1/2005 | Berrang et al. | |
| 2005/0036639 | A1 | 2/2005 | Bachler et al. | |
| 2005/0163333 | A1 | 7/2005 | Abel et al. | |
| 2006/0023908 | A1 | 2/2006 | Perkins et al. | |
| 2006/0062420 | A1 | 3/2006 | Araki | |
| 2006/0107744 | A1 | 5/2006 | Li et al. | |
| 2006/0177079 | A1 | 8/2006 | Baekgaard Jensen et al. | |
| 2006/0189841 | A1 | 8/2006 | Pluvinage | |
| 2006/0233398 | A1 | 10/2006 | Husung | |
| 2006/0251278 | A1 | 11/2006 | Puria et al. | |
| 2007/0083078 | A1 | 4/2007 | Easter et al. | |
| 2007/0100197 | A1 | 5/2007 | Perkins et al. | |
| 2007/0127748 | A1 | 6/2007 | Carlile et al. | |
| 2007/0191673 | A1 | 8/2007 | Ball et al. | |
| 2008/0021518 | A1 | 1/2008 | Hochmair et al. | |
| 2008/0107292 | A1 | 5/2008 | Kornagel | |

FOREIGN PATENT DOCUMENTS

| | | | |
|---|---|---|---|
| DE | 2044870 | | 3/1972 |
| DE | 3243850 | A1 | 5/1984 |
| EP | 0 296 092 | | 12/1988 |
| EP | 1 845 919 | | 10/2007 |
| FR | 2455820 | | 11/1980 |
| JP | 60-154800 | | 8/1985 |
| WO | WO 99/03146 | | 1/1999 |
| WO | WO 99/15111 | | 4/1999 |
| WO | WO 03/063542 | A2 | 7/2003 |
| WO | WO 2005/015952 | | 2/2005 |
| WO | WO 2006/042298 | A2 | 4/2006 |
| WO | WO 2006/075175 | | 7/2006 |

OTHER PUBLICATIONS

Atasoy [Paper] "Opto-acoustic Imaging" for BYM504E Biomedical Imaging Systems class at ITU, downloaded from the Internet <<http://www2.itu.edu.tr/~cilesiz/courses/BYM504-2005-OA_504041413.pdf>>, 14 pages.

Athanassiou et al., "Laser controlled photomechanical actuation of photochromic polymers Microsystems" Rev. Adv. Mater. Sci., 2003; 5:245- 251.

Ayatollahi et al., "Design and Modeling of Micromachined Condenser MEMS Loudspeaker using Permanent Magnet Neodymium-Iron-Boron (Nd-Fe-B)," IEEE International Conference on Semiconductor Electronics, 2006. ICSE '06, Oct. 29, 2006-Dec. 1, 2006; pp. 160-166.

Baer et al., "Effects of Low Pass Filtering on the Intelligibility of Speech in Noise for People With and Without Dead Regions at High Frequencies," J Acoust Soc Am. Sep. 2002;112(3 Pt 1):1133-1144.

Best et al., "Influence of High Frequencies on Speech Locatisation," Abstract 981, Feb. 24, 2003, retrieved from: <http://www.aro.org/abstracts.html> .

Birch et al., "Microengineered systems for the hearing impaired," IEE Colloquium on Medical Applications of Microengineering, Jan. 31, 1996; pp. 2/1-2/5.

Burkhard et al., "Anthropometric Manikin for Acoustic Research," J Acoust Soc Am. Jul. 1975;58(1):214-22.

Camacho-Lopez et al., "Fast Liquid Crystal Elastomer Swims Into the Dark," Electronic Liquid Crystal Communications, (Nov. 26, 2003), 9 pages total.

Carlile et al., Abstract 1264—"Spatialisation of Talkers and the Segregation of Concurrent Speech ," Feb. 24, 2004, retrieved from: http://www.aro.org/archives/2004/2004_1264.html.

"EAR", Retrieved from the Internet: <<http://wwwmgs.bionet.nsc.ru/mgs/gnw/trrd/thesaurus/Se/ear.html>>, 4 pages total.

Cheng et al., "A Silicon Microspeaker for Hearing Instruments," Journal of Micromechanics and Microengineering 2004; 14(7):859-866.

Datskos et al., "Photoinduced and thermal stress in silicon microcantilevers", Applied Physics Letters, Oct. 19, 1998; 73(16):2319-2321.

Decraemer et al., "A Method for Determining Three-Dimensional Vibration in the Ear," *Hearing Research*, 77 (1-2): 19-37 (1994).

Fay et al., "Cat Eardrum Response Mechanics," Mechanics and Computation Division, Department of Mechanical Engineering, Stanford University, (2002), 10 pages total.

Fletcher, "Effects of Distortion on the Individual Speech Sounds", Chapter 18, *ASA Edition of Speech and Hearing in Communication*, Acoust Soc.of Am. (republished in 1995) pp. 415-423.

Freyman et al., "Spatial Release from Informational Masking in Speech Recognition," J Acoust Soc Am. May 2001;109(5 Pt 1):2112-2122.

Freyman et al., "The Role of Perceived Spatial Separation in the Unmasking of Speech," J Acoust Soc Am. Dec. 1999;106(6):3578-3588.

Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.

Gobin et al; "Comments on the physical basis of the active materials concept" *Proc. SPIE* 4512:84-92.

Hato et al., "Three-Dimensional Stapes Footplate Motion in Human Temporal Bones." *Audiol Neurootol*, 2003; 8: 140-152.

"Headphones" Wikipedia Entry, downloaded from the Internet : <<http://en.wikipedia.org/wiki/Headphones>>, 9 pages total.

Hofman et al., "Relearning Sound Localization With New Ears," Nat Neurosci. Sep. 1998;1(5):417-421.

Jin et al., "Speech Localization", J. Audio Eng. Soc. convention paper, presented at the *AES* 112th Convention, Munich, Germany, May 10-13, 2002, 13 pages total.

Killion, "Myths About Hearing Noise and Directional Microphones," *The Hearing Review*, vol. 11, No. 2, (Feb. 2004), pp. 14, 16, 18, 19, 72 & 73.

Killion, "SNR loss: I can hear what people say but I can't understand them," The Hearing Review, 1997; 4(12):8-14.

Lee et al., "A Novel Opto-Electromagnetic Actuator Coupled to the tympanic Membrane" Journal of Biomechanics , 41(16): 3515-3518.

Lezal, "Chalcogenide glasses—survey and progress", J. Optoelectron Adv Mater., Mar. 2003; 5 (1):23-34.

Martin et al. "Utility of Monaural Spectral Cues is Enhanced in the Presence of Cues to Sound-Source Lateral Angle," *JARO*, vol. 5, (2004), pp. 80-89.

Moore, "Loudness Perception and Intensity Resolution", *Cochlear Hearing Loss*, Whurr Publishers Ltd., (1998), Chapter 4, pp. 90-115.
Musicant et al., "Direction-Dependent Spectral Properties of Cat External Ear: New Data and Cross-Species Comparisons, " *J. Acostic. Soc. Am*, May 10-13, 2002, Feb. 1990; 8(2):757-781.
National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.
Poosanaas et al., "Influence of sample thickness on the performance of photostrictive ceramics," J. App. Phys., Aug. 1, 1998, 84(3):1508-1512.
Puria et al., "A gear in the middle ear," ARO Denver CO, 2007b.
Puria and Allen, "Measurements and Model of the Cat Middle Ear: Evidence of Tympanic Membrane Acoustic Delay," Journal of the Acoustical Society of America, 104 (6): 3463-3481 (1998).
Puria et al., "Middle Ear Morphometry From Cadaveric Temporal Bone MicroCT Imaging," Proceedings of the 4th International Symposium, Zurich, Switzerland, Jul. 27-30, 2006, Middle Ear Mechanics in Research and Otology, pp. 259-268.
Puria et al., "Sound-Pressure Measurements in the Cochlear Vestibule of Human-Cadaver Ears," Journal of the Acoustical Society of America, 101 (5-1): 2754-2770, (1997).
Shaw, "Transformation of Sound Pressure Level From the Free Field to the Eardrum in the Horizontal Plane," *J. Acoust. Soc. Am.*, Dec. 1974; 56(6):1848-1861.
Shih, "Shape and displacement control of beams with various boundary conditions via photostrictive optical actuators," *Proc. IMECE* Nov. 2003, pp. 1-10.
Stuchlik et al, "Micro-Nano actuators driven by polarized light", *IEE Proc. Sci. Meas. Techn*. Mar. 2004, 151(2::131-136.
Suski et al., Optically activated ZnO/SiO2/Si cantilever beams, Sensors & Actuators, 1990; 24:221-225.
Takagi et al.; "Mechanochemical Synthesis of Piezoelectric PLZT Powder", *KONA*, 2003, 151(21):234-241.
Thakoor et al., "Optical microactuation in piezoceramics", Proc. SPIE, Jul. 1998; 3328:376-391.
Tzou et al; "Smart Materials, Precision Sensors/Actuators, Smart Structures, and Structronic Systems", *Mechanics of Advanced Materials and Structures*, 2004;11:367-393.
Uchino et al.; "Photostricitve actuators," *Ferroelectrics* 2001; 258:147-58.
Vickers et al., "Effects of Low-Pass Filtering on the Intelligibility of Speech in Quiet for People With and Without Dead Regions at High Frequencies," J Acoust Soc Am. Aug. 2001;110(2):1164-1175.
Wang et al., "Preliminary Assessment of Remote Photoelectric Excitation of an Actuator for a Hearing Implant," Proceeding of the 2005 IEEE, Engineering in Medicine and Biology 27th Annual Conference, Shanghai, China, Sep. 1-4, 2005, pp. 6233-6234.
Wiener et al., "On the Sound Pressure Transformation by the Head and Auditory Meatus of the Cat", *Acta Otolaryngol*. Mar. 1996;61(3):255-269.
Wightman et al., "Monaural Sound Localization Revisited," J Acoust Soc Am. Feb. 1997;101(2):1050-63.
Yi et al., "Piezoelectric Microspeaker with Compressive Nitride Diaphragm," The Fifteenth IEEE International Conference on Micro Electro Mechanical Systems, 2002; pp. 260-263.
Yu et al. "Photomechanics: Directed bending of a polymer film by light", Nature, Sep. 2003; 425(6954):145.
U.S. Appl. No. 61/073,271, filed Jun. 17, 2008, inventor: Lee Felsenstein.
U.S. Appl. No. 61/073,281, filed Jun. 17, 2008, inventor: Lee Felsenstein.
U.S. Appl. No. 60/702,532, filed Jul. 25, 2005, inventor: Nikolai Aljuri.
U.S. Appl. No. 61/099,087, filed Sep. 22, 2008, inventor: Paul Rucker.

* cited by examiner 410 412

| Parameter | Values |
|---|---|
| D | 3.5mm |
| $L_c$ | 4mm |
| z | 4mm |
| Vrms | 1.77 V |
| Imax | 300mA |
| fmax | 8 kHz |
| Dc | 1.5 mm to 3.3mm |
| Wire gauge | 38 to 42AWG |

610 620 630 640 650

| Parameters | | $L_c$ = 4 mm | | $L_c$ = 15mm |
|---|---|---|---|---|
| | Coil #1 Values | Coil #2 Values | Coil #3 Values | Coil #4 Values |
| Wire Gauge | 40 | 42 | 40 | 37 |
| Number of turns | 129 | 432 | 215 | 230 |
| Core diameter | 2.8mm | 2.2mm | 2.4mm | 2.0mm |
| Resistance | 4.2 Ω | 20.7 Ω | 6.7 Ω | 2.9 Ω |
| Inductance | 0.10 mH | 1.08 mH | 0.27 mH | 0.47 mH |
| Bmax field @ z @ 8 kHz | 0.74 mT | 0.27 mT | 0.52 mT | 0.36 mT |
| B/I @ z | 2.8 mT/A | 8.7 mT/A | 4.4 mT/A | 4.9 mT/A |

FIG. 6

ENERGY DELIVERY AND MICROPHONE PLACEMENT METHODS FOR IMPROVED COMFORT IN AN OPEN CANAL HEARING AID

CROSS-REFERENCES TO RELATED APPLICATIONS

The present application claims the benefit under 35 USC 119(e) of U.S. Provisional Application No. 60/977,605 filed Oct. 4, 2007; the full disclosure of which is incorporated herein by reference in its entirety.

The subject matter of the present application is related to copending U.S. patent application Ser. Nos. 10/902,660 filed Jul. 28, 2004, entitled "Transducer for Electromagnetic Hearing Devices"; 11/248,459 filed on Oct. 11, 2005, entitled "Systems and Methods for Photo-Mechanical Hearing Transduction"; 11/121,517 filed May 3, 2005, entitled "Hearing System Having Improved High Frequency Response"; 11/264,594 filed on Oct. 31, 2005, entitled "Output Transducers for Hearing Systems"; 60/702,532 filed on Jul. 25, 2006, entitled "Light-Actuated Silicon Sound Transducer"; 61/073,271 filed on Jun. 17, 2008, entitled "Optical Electro-Mechanical Hearing Devices With Combined Power and Signal Architectures"; and 61/073,281 filed on Jun. 17, 2008, entitled "Optical Electro-Mechanical Hearing Devices with Separate Power and Signal Components"; the complete disclosures of which are incorporated herein by reference.

BACKGROUND OF THE INVENTION

The present invention relates generally to hearing systems, devices, output transducer supports, and methods. More particularly, the present invention is directed to hearing systems that comprise an elongate support adapted to minimize contact with the ear while the transducer is positioned near the user's eardrum, thereby providing improved comfort to the user. The systems may be used to enhance the hearing process of those that have normal or impaired hearing with comfort.

People who wear hearing aids would like hearing aids with certain characteristics, such as cosmetic appeal, comfort and sound quality. With respect to comfort, hearing aids are often used for prolonged periods of time and people generally do not want to use a device that is uncomfortable. Although the importance of cosmetics will vary among individuals, people generally have a desire to hide a handicap such as a hearing deficit. Amplified sound quality is also important, in particular restoring the ears natural ability to detect sound localization cues at high frequencies. Although current hearing aids provide some benefit to the user, the above characteristics are generally not all satisfied with a single device.

Efforts to improve hearing aids have often resulted in an improvement of one characteristic at the expense of another. Early hearing aids included behind the ear hearing aides (hereinafter "BTE aids") that placed much of the hearing aid electronics, for example the microphone and speaker, behind the ear. Although BTE aides provided somewhat improved hearing, these aids were readily apparent on the user and not cosmetically attractive. Advancements in electronics technology provided smaller components that led to the development of the completely in canal hearing aid (hereinafter "CIC aids"). The CIC aids have desirable cosmetics because the device is generally deep in the canal and not visible. However, these devices can be uncomfortable due to jaw movements, and the user's own voice can sound hollow and unnatural.

The unnatural and hollow sound that can occur with CIC aids has been referred to the occlusion effect. To reduce the occlusion effect, a vent can be placed in the CIC device that allows sound waves to pass through the device. Although such vents can improve the sound quality of the user's own voice, vents can also cause unwanted feedback, which produces a whistling sound.

A potential problem with hearing aids that place the microphone behind the pinna of the ear is that directionally dependent sound localization cues, for example in the 6 to 12 kHz frequency range, may not be present in the amplified signal. As described in the co-pending U.S. patent application Ser. No. 11/121,517, filed May 3, 2005, entitled "Hearing System Having Improved High Frequency Response", these localization cues are important for understanding speech, for example speech of a desired person in the presence of additional people who are also speaking. Although placing the microphone near the ear canal can improve these sound localization cues, the microphone is often near a sound emitting transducer, such as a speaker, so that feedback can result.

Although open canal hearing aids can provide improved comfort, these devices have generally been deficient with respect to other desired characteristics. For example, some open canal hearing aids use external electronics, for example microphones and speakers such that these devices may not be cosmetically appealing. Also, open canal hearing aids have generally had limited success in providing frequency dependent sound localization cues. Open canal hearing aids are described in U.S. Pat. No. 5,987,146 and have been sold under the name of ReSound AiR, available from GN ReSound North America, Bloomington, Minn. Several modifications and refinements have been made to the original open canal hearing aids, for example as described in U.S. Pat. No. 5,606,621 and U.S. Pub. Nos. US 2005/0078843 and 2005/0190939, and open canal hearing aids are commercially available, for example from Vivatone Hearing Systems LLC of Shelton Conn.

Hearing aids with the sound sensitive microphone positioned in the ear canal show some promise of potentially providing sound localization cues. However, placement of the microphone in the canal of an acoustic hearing aid which uses a sound generating speaker positioned in the ear canal can produce significant feedback. Thus, many open canal acoustic hearing aids do not use a microphone in the ear canal. Although the amplification gain of a hearing aid device can be decreased to reduce feedback, decreasing the gain can also make it harder for a user to hear weak sounds, which is contrary to the purpose of wearing a hearing aid device. Because of this feedback that generally precludes placement of the microphone in the ear canal, many acoustic hearing aids do not provide directionally dependent sound localization cues. One approach to providing sound localization cues has been to provide a directional microphone instead of an omnidirectional microphone. However in at least some instances, devices using directional microphones have met with only limited success.

One promising approach to provide sound localization cues has been to place the microphone inside the ear canal and drive the eardrum or other ear structure directly with non-acoustic energy, for example with electromagnetic energy, so that feedback is reduced. Rather than using acoustic energy to drive the eardrum, the eardrum can be driven electromagnetically with a magnet placed on the ear so as to reduce the acoustic feedback to the ear canal microphone as discussed in U.S. Pat. Nos. 5,259,032; 5,276,910; and 5,425,104; as well as U.S. patent application Ser. No. 11/121,517 and U.S. Patent Application Publication No. 2006/0023908, entitled "Transducer for Electromagnetic Hearing Devices". Such devices typically use a coil wrapped around a core (hereinafter "core/coil") to transmit electromagnetic energy from the coil to the magnet positioned on the ear structure.

One difficulty encountered with hearing aid devices that use a coil to electromagnetically drive a magnet positioned on the eardrum, stapes or other ear structure is that such devices can be uncomfortable for the user. Work in relation with the present invention suggests that this discomfort is associated with placement of the coil deep within the ear canal near the eardrum. One the one hand, this placement near the eardrum is desirable as the coil is near the magnet positioned on the ear structure so that electromagnetic energy can be effectively coupled to the magnet. However, as the coil is positioned near the eardrum, the coil should be held accurately to avoid damage to the eardrum. With such devices, an ear canal shell can be used to hold the core/coil in place deep within the ear canal. Although the shell can be customized specific to each user, for example molded, and have openings to provide an open canal hearing aid design, such devices have provided less than ideal results. In particular, users can experience skin irritation, discomfort, and even ear pain due to friction between the shell and the canal skin. Friction can arise from speech production, mastication, and swallowing, potentially causing irritation and discomfort.

In addition to the shortcomings described above, present coil designs for electromagnetically driven eardrum magnet hearing aids may be less than ideal. In some instance, the size requirements of the coil are dictated by electromagnetic field requirements (B fields) to drive the magnet. However, the size of the coil of such devices may be larger than necessary and contribute to user discomfort.

In light of the above, what is needed is a comfortable hearing aid device that is cosmetically attractive and provides good sound quality including sound localization cues.

Description of the Background Art. U.S. Pat. Nos. 5,259,032; 5,276,910; 5,425,104; 5,987,146 and 5,606,621 have been described above. Other patents of interest include: U.S. Pat. Nos. 4,800,084; 5,804,109; 6,084,975 and 6,436,028. Patent Application Publication Nos. 2005/0078843; 2005/0190939 and 2006/0023908 have been described above. World Intellectual Property Organization (hereinafter "WIPO") publication WO/2006/042298 is of interest. Journal publications of interest include: Hammershoi and Moller, "Sound transmission to and within the human ear canal," *J. Acoust. Soc. Am.,* 100(1):408-427; Decraemer et al., "A method for determining three-dimensional vibration in the ear," *Hearing Res.,* 77:19-37 (1994); Puria et al., "Sound-pressure measurements in the cochlear vestibule of human cadaver ears," *J. Acoust. Soc. Am.,* 101(5):2754-2770 (May 1997); Moore, "Loudness perception and intensity resolution," *Cochlear Hearing Loss, Chapter* 4, pp. 90-115, Whurr Publishers Ltd., London (1998); Puria and Allen "Measurements and model of the cat middle ear: Evidence of tympanic membrane acoustic delay," *J. Acoust. Soc. Am.,* 104(6):3463-3481 (December 1998); Hoffman et al. (1998); Fay et al., "The discordant eardrum," *Proc. Nat. Academ. Sci. USA* 103 (52):1974-8 (2006); and Hato et al., "Three-dimensional stapes footplate motion in human temporal bones," *Audiol. Neurootol.,* 8:140-152 (Jan. 30, 2003). Conference presentation abstracts from the Association for Research in Otolaryngology: Best et al., "The influence of high frequencies on speech localization," Abstract 981 (Feb. 24, 2003); and Carlile and Schonstein, "Frequency bandwidth and multi-talker environment," Aud. Eng. Soc. (2006).

BRIEF SUMMARY OF THE INVENTION

The present invention provides hearing systems, devices, output transducer supports, and methods that improve user comfort and position a transducer deep in the ear canal. The output transducer supports, devices and hearing systems of the present invention may comprise an elongate support adapted to minimize, and even avoid, contact with the ear while the transducer is positioned near the user's eardrum, thereby avoiding frictional contact with the ear and providing improved comfort for the user. In many embodiments, the support comprises a flexible support that can bend and/or flex in response to user movement, so as to provide comfort to the user.

In a first aspect, embodiments of the present invention provide a hearing aid device for placement in an ear of a user. The device comprises an elongate support and an energy delivery transducer. The elongate support has a proximal portion and a distal end. The energy delivery transducer is attached to the elongate support near the distal end. The support is adapted to position the transducer near an eardrum while the proximal portion is placed at the location near an ear canal opening. An intermediate portion of the elongate support is sized to minimize contact with the ear between the proximal portion and distal end.

In many embodiments, the elongate support includes specific adaptations to provide user comfort. Often, the elongate support is adapted to at least partially support the transducer from the proximal portion, thereby reducing support of the transducer by the ear within the canal. The intermediate portion extends along at least about 50% of a distance from the proximal portion to the distal end, and the distance corresponds to a distance of a canal of the ear, thereby avoiding contact with the ear along much of the support. Also, the elongate support has a cross sectional width, for example a diameter, less than a cross sectional width, for example a diameter, of the transducer. In a specific embodiment, the elongate support is adapted to flex in response to user movement for improved comfort, for example jaw movement, which decreases pressure on the ear within the canal when the user moves, and the elongate support is adapted to conduct heat from the energy delivery transducer.

In further embodiments, a positioner is attached to the elongate support near the transducer and is adapted to contact the ear in the canal near the transducer and support the transducer. The positioner can include specific adaptations to provide user comfort. For example, the positioner can be sufficiently wide to contact the ear in the canal so as to support the transducer, and the positioner can include a flexible portion adapted to bend while the positioner is positioned in the canal. Additionally, the positioner is often adapted to suspend and center the transducer in the canal to avoid transducer to ear contact while the positioner contacts the ear. To avoid occlusion, the positioner includes openings formed thereon to pass sound waves through the openings. The positioner can include flanges, petals or spokes that define the openings. The positioner includes an outer boundary that can be oval, circular, or even molded to the user's ear, and is adapted to engage the canal while the positioner suspends the transducer in the canal. The positioner can be tapered proximally to facilitate insertion into the canal. Often, the positioner will comprise a thickness no more than a length of the transducer.

In many embodiments, the transducer is adapted for user comfort. For example, the transducer has a width of no more than about 4 mm, thereby avoiding contact with the ear. Although the transducer can be adapted to transmit electromagnetic energy toward the eardrum to stimulate a magnet suspended on the eardrum and/or an ossicle, other forms of energy, for example ultrasound, can be transmitted toward the eardrum. While the transducer can be a coil adapted to transmit electromagnetic energy toward the eardrum with frequency components in the audio range, other frequencies of electromagnetic energy can be used, for example optical and radio frequencies.

In specific embodiments, the transducer comprises a coil. The coil comprises a length from about 3 to 6 mm and a width from about 3 to 4 mm. In a specific embodiment, the coil is adapted to drive a magnet positioned on an eardrum while a distal end of the coil is positioned a distance from about 2 to 6 mm from the eardrum.

In some embodiments, the transducer is adapted to transmit electromagnetic energy toward the eardrum, and the electromagnetic energy comprises optical frequencies.

Many embodiments include a microphone attachable to the support near the proximal portion of the support to position the microphone near the opening to the ear canal. The microphone is adapted to generate an electrical signal in response to an audio signal. A processor connected to the microphone is adapted to modify the audio signal from the microphone with a transform function and apply the modified audio signal to the transducer to stimulate the ear. The processor and a battery to power the processor can be adapted to be worn behind a pinna of the ear. The microphone can be attached to the support to position the microphone within about 6 mm of the opening to the canal.

In many embodiments, the elongate support defines an enclosure, and a microphone is positioned within the enclosure. The intermediate portion may comprise the enclosure, and the microphone may be positioned within the intermediate portion.

In many embodiments, the elongate support comprises at least one opening and the microphone is configured to measure a sound pressure of the ear canal through at least one opening. The elongate support may comprise a flexible tube and the enclosure may comprise a lumen of the tube.

In many embodiments, the energy delivery transducer comprises a coil assembly positioned within the enclosure. An opening of the microphone can be positioned no more than about 12 mm from a proximal end of the coil to measure a sound pressure of the ear canal near the eardrum.

In specific embodiments, the microphone is adapted to be worn behind a pinna of the ear, and the microphone comprises a probe tube that extends to the ear canal opening; the probe tube has an opening near the ear canal opening such that the microphone detects sound from the ear canal opening.

In another aspect, embodiments of the present invention provide a hearing aid system for use with an ear. The system comprises a microphone, a processor, a transducer and a flexible elongate support. The microphone is adapted to generate a signal. The processor connected to the microphone and adapted to apply a transform function to the signal to produce a transformed signal. The transducer is adapted to receive the transformed signal and emit electromagnetic energy in response to the transformed signal. The flexible elongate support includes a proximal portion and a distal end. The flexible elongate support extends at least from the proximal portion to the distal end, and the proximal portion is adapted for placement near an opening of an ear canal. The distal end is adapted to support the transducer near an eardrum while the proximal portion is placed near the opening.

In many embodiments, an intermediate portion of the elongate support located between the proximal portion and the distal end is sized to avoid contact with the ear.

In specific embodiments, the elongate support is adapted to suspend the transducer in the ear canal to avoid contact with the ear. A positioner can be attached to the elongate support near the transducer, the wide is support adapted to engage the canal of the ear to suspend the transducer in the canal to avoid transducer to ear contact while the proximal portion is placed near the opening of the canal.

In many embodiments, the microphone is disposed near the proximal portion to position the microphone near the opening to the ear canal when the proximal portion is placed near the opening. In specific embodiments, the support can be adapted to position the microphone within about 6 mm of the opening and position a distal end of the transducer from about 2 to 6 mm from the eardrum, while the proximal portion is placed near the opening.

In many embodiments, the elongate support defines an enclosure, and a microphone is positioned within the enclosure. The intermediate portion may comprise the enclosure and the microphone can be positioned within the intermediate portion. The elongate support may comprise at least one opening, and the microphone may be configured to measure a sound pressure of the ear canal through the at least one opening. In specific embodiments, the elongate support may comprise a flexible tube and the enclosure may comprise a lumen of the tube. The energy delivery transducer may comprise a coil positioned within the enclosure, and an opening of the microphone may be no more than about 12 mm from a proximal end of the coil to measure a sound pressure of the ear canal near the eardrum.

In many embodiments, a magnet is adapted for placement on the eardrum, and the magnet adapted to receive the electromagnetic energy from the transducer to drive the eardrum and stimulate the ear. Although the microphone is often placed near the opening to the ear canal or within the ear canal, the microphone can be adapted to be worn behind a pinna of the ear with a tube having an opening within about 6 mm of the ear canal opening.

In another aspect, embodiments of the present invention comprise a method of fitting a hearing aide device to a user. A transducer, a microphone and elongate support for placement in an ear canal of the user are provided. A user characteristic is measured. The measured user characteristic is one that is correlated with a distance from an opening of an ear canal to the user's tympanic membrane. A length along the elongate support is determined based on the measured characteristic to position the transducer near the tympanic membrane when the support is placed in the ear canal. The length is determined before the support is placed in the ear canal. The length is determined to position the transducer near the tympanic membrane when the support is placed in the ear canal.

In many embodiments, a size of a positioner is determined for placement in the ear canal near the transducer. The positioner is sized to contact the ear to support and center the transducer in the ear canal and avoid contact between the transducer and the ear. The length of the elongate support is determined to position the transducer from about 2 to 6 mm from the tympanic membrane.

In many embodiments, the length along the elongate support is determined to position the microphone near the opening of the ear canal when the support is placed in the ear canal. The microphone can be positioned at the location along the support to position the microphone within about 6 mm of the opening of the ear canal while the transducer is positioned near the tympanic membrane, and the microphone can be positioned in response to the length of the elongate support.

In many embodiments, the elongate support defines an enclosure, and a microphone is positioned within the enclosure. The intermediate portion may comprise the enclosure and the microphone can be positioned within the intermediate portion. The elongate support may comprise at least one opening, and the microphone may be configured to measure a sound pressure of the ear canal through the at least one opening.

In many embodiments, the elongate support may comprise a flexible tube and the enclosure may comprise a lumen of the tube. The energy delivery transducer may comprise a coil positioned within the enclosure, and an opening of the microphone may be about 12 mm or less from a proximal end of the coil to measure a sound pressure of the ear canal near the eardrum.

The length of the elongate support is determined to minimize contact with the ear between the microphone and the transducer.

In a further aspect, embodiments of the present invention provide an energy delivery transducer for use in an ear canal with a hearing aid. The transducer comprises a coil assembly and a biocompatible coating. The coil assembly comprises a wire with turns adapted to generate a magnetic field. The coil assembly has a length from about 3 to 6 mm and a maximum cross sectional width from about 3 to 4 mm. The coil assembly is adapted for placement in the canal of the ear to permit sound waves to travel along the canal past the coil between the coil and the canal. The biocompatible coating is disposed on and around the coil to protect the ear.

In many embodiments, the coil includes a number of turns and the number of turns is from about 100 to about 450 turns. The wire comprises a gauge in a range from about 36 to about 44 gauge, although the range can be narrower, for example from about 38 to 42. The coil assembly comprises a length from about 3 to 6 mm, although the length can be from about 3.5 to 5 mm, for example 4 about mm. The coil assembly comprises a width from about 1 to about 4 mm, for example from about 3.2 to about 4.2 mm. The transducer can include a core with the wire placed around the core with turns of the wire. The core can include a maximum cross sectional width from about 0.5 to about 3.3 mm, for example from about 1.5 to 3.3 mm.

In another aspect, a modular hearing aid assembly for use with an ear of a user is provided. The assembly comprises a behind the ear component. The behind the ear component comprises a battery and a processor, and the behind the ear component sized to fit at least partially behind a pinna of the user. An elongate canal component comprises a coil assembly shaped to fit in an ear canal and adapted to transmit electromagnetic energy toward and drive a magnet suspended on an eardrum and/or an ossicle of the user. The elongate canal component is adapted to flex in response to user movement. An elongate pinna component has a first end configured to connect to the behind the ear component and a second end configured to connect to the transducer component.

In many embodiments, the elongate canal component comprises an annular section adapted to flex in response to user movement. The elongate pinna component may comprise a first connector on the first end adapted to mate with a connector on the behind the ear component and a second connector on the second end adapted to mate with a connector on the canal component.

In many embodiments, a length of the elongate pinna component and a length of the elongate canal component are each sized to fit the user.

In many embodiments, the elongate pinna component comprises a flexible tubing having wires disposed therein. The flexible tubing may comprise plastic and the wires can be sized to support the pinna component. The wires sized to support the pinna component can transmit electrical energy from the behind the ear component to the elongate transducer component.

In many embodiments, the elongate pinna component comprises a microphone located near the second end to detect sound near an opening of the ear of the user.

In some embodiments, the elongate pinna component comprises an elongate tube adapted to conduct sound from an opening in the user's ear near the second end to a microphone positioned near the first end, such that the microphone detects sound from the opening in the user's ear with sound conducted along the elongate tube. The microphone can be located in the behind the ear component, and the elongate tube can extend to the microphone.

In another aspect, embodiments of the present invention provide a method of fitting a hearing aid device to an ear of a user. An elongate pinna component is selected, in which the selected elongate pinna component has a length related to a distance from an opening in the users ear to an upper portion of a pinna of the user. An elongate ear canal component is selected in which the elongate ear canal component has a length related to a length of a canal of the ear of the user.

In many embodiments, the pinna component is selected from among at least two sizes of pinna components, and the canal component is selected from among at least two sizes of canal components. For example, the pinna component can be selected from among at least three sizes of pinna components, and the canal component can be selected from among at least three sizes of canal components.

In many embodiments, the pinna component is selected based on a size of the pinna and the canal component is selected based on a size, for example a length, of the user's canal.

In another aspect, embodiments of the present invention provide a hearing aid device for placement in an ear of a user. The device comprises an elongate support having a proximal portion and a distal end. An energy delivery transducer is coupled to the elongate support to transmit electromagnetic energy comprising optical frequencies from the distal end. A positioner is coupled to the elongate support and configured to position the distal end within the ear canal.

In many embodiments, the energy delivery transducer comprises at least one of a light emitting diode or a laser diode coupled to the proximal portion of the elongate support to transmit optical energy to the distal end. The elongate support may comprise at least one waveguide, for example a single waveguide or a plurality of two or more waveguides, configured to transmit optical energy at least from the proximal portion to the distal end. The support can be adapted to position the distal end near an eardrum when the proximal portion is placed at a location near an ear canal opening. An intermediate portion of the elongate support can be sized to minimize contact with a canal of the ear between the proximal portion to the distal end.

BRIEF DESCRIPTION OF THE DRAWINGS

FIG. 6 shows tradeoffs in the design variables for three different coils with 4 mm length cores, according to embodiments of the present invention;

FIG. 8B-1 shows an elongate support configured to position a distal end of the elongate support with at least one positioners placed in an ear canal, according to embodiments of the present invention;

DETAILED DESCRIPTION OF THE INVENTION

Figure 1A:
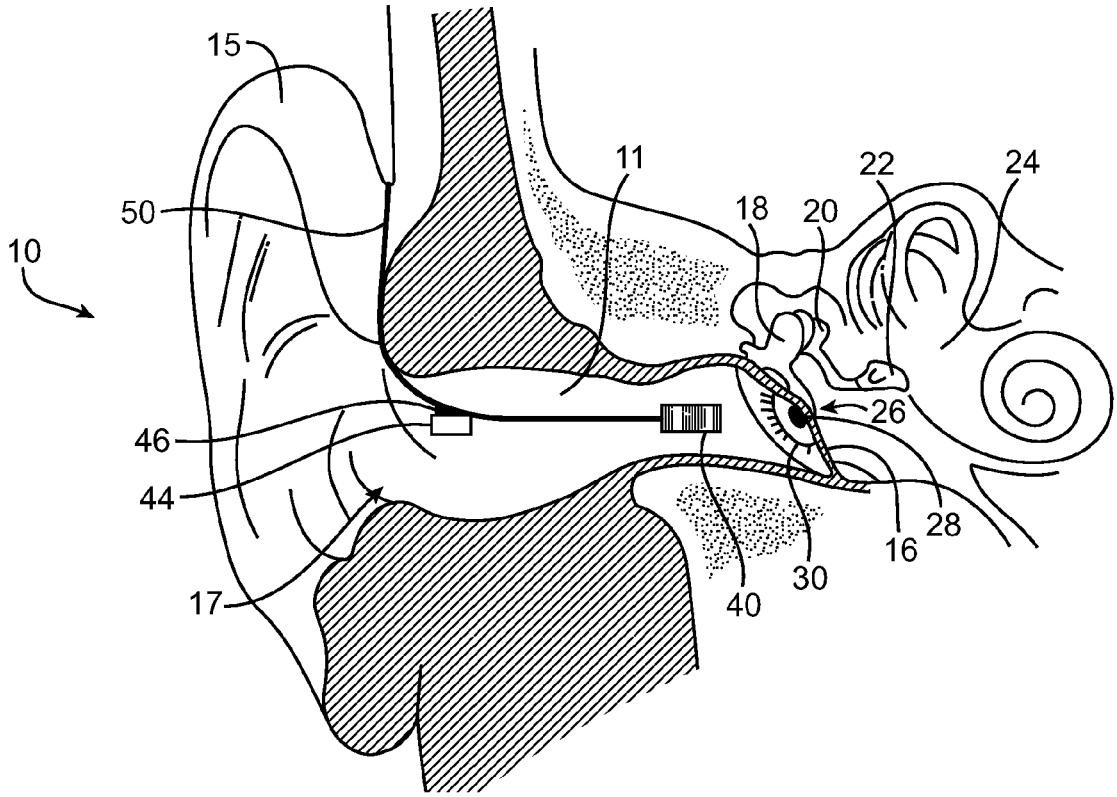
FIG. 1A shows a hearing aid device with an elongate support with the transducer positioned near an eardrum of a user, according to embodiments of the present invention.

FIG. 1A shows a hearing aid device with an elongate support 50 with a transducer is positioned near an eardrum of a user, according to embodiments of the present invention. An ear 10 includes a pinna 15 and an ear canal 11. Ear canal 11 extends laterally to an opening 17, which is an entrance to the ear canal from outside the user. The outer ear comprises pinna 15 and ear canal 11. Ear canal 11 extends medially to a tympanic membrane 16 (eardrum). Tympanic membrane 16 is mechanically coupled to three bones: a malleus 18 (hammer), an incus 20 (anvil) and a stapes 22 (stirrup). Collectively, these three bones are known as the ossicles or the ossicular chain. The malleus is coupled to the tympanic membrane. The middle ear comprises the tympanic membrane and the ossicles. The inner ear comprises a cochlea 24, a spiral structure. The stapes 22 is coupled to the cochlea 24 so that acoustic energy is transmitted from the tympanic membrane to the inner ear via the ossicles.

Several components of the hearing aid device are attached to elongate support 50. A microphone 44 is shown attached to elongate support 50 near opening 17. A coil assembly 40 is shown supported by elongate support 50. Coil assembly 40 includes a coil of wire wrapped around a ferromagnetic core and a biocompatible coating. Coil assembly 17 is an energy delivery transducer that converts electrical current to a magnetic field. The magnetic field is transmitted a permanent magnet 28. Permanent magnet 28 is positioned on a support component 30 that is removably attached to tympanic membrane 16. The magnetic field transmitted to permanent magnet 28 applies a force to the tympanic membrane. The applied force causes tympanic membrane 16 to move in a manner similar that which occurs when sound impinges on the tympanic membrane in the normal manner. Magnet 28 and support component 30 are available from available from EarLens Corporation of Redwood City, Calif. In alternate embodiments, a magnet and/or a magnetic material is attached to at least one of the malleus, the incus and the stapes, and coil assembly 17 is used to drive the magnet and/or magnetic material.

Elongate support 50 functions as a scaffolding to hold the microphone and coil assembly in place. Elongate support 50 includes structures that allow the support to hold the energy delivery transducer and microphone in place while permitting elongate support 50 to flex and/or bend to accommodate user motion and individual user characteristics. Elongate support 50 can comprise a tube to hold the wires for transducers, for example microphone 44 and coil assembly 40. The elongate support can include a flexible cable, for example a cable formed from the wires electrically connected to a transducer such as coil 40. Coil assembly 40 is attached near the end of elongate support 50. Elongate support 50 is shaped to position a distal end of coil assembly 40 from about 2 to 6 mm from tympanic membrane 16, for example about 4 mm from tympanic membrane 16. Coil assembly 40 is adapted to electromagnetically drive permanent magnet 28 while a distal end of coil assembly 40 is positioned from 2 to 6 mm from tympanic membrane 16, for example 4 mm from tympanic membrane 16.

As shown FIG. 1A, microphone 44 is attached to elongate support 50 and positioned inside ear canal 11 near opening 17. This placement of microphone 44 permits detection of high frequency sound localization cues. Microphone 44 is attached to the elongate support using an adhesive 46 that can comprise any commercially available adhesive. Other embodiments use other forms of attachment of microphone 44 to elongate support 50, for example a collar that wraps around elongate support 50 and holds microphone 44 in place with friction. Thus, microphone 44 can be slid along elongate support 50 to position the microphone along elongate support 50 at a desired location. Microphone 44 comprises any of the commercially available types, for example electret type, condenser type, and piezoelectric type including polyvinylidene fluoride polymer (herein after "PVDF"). Another microphone type that can be used is the optical microphone which may reduce electromagnetic interference.

Figure 1B:
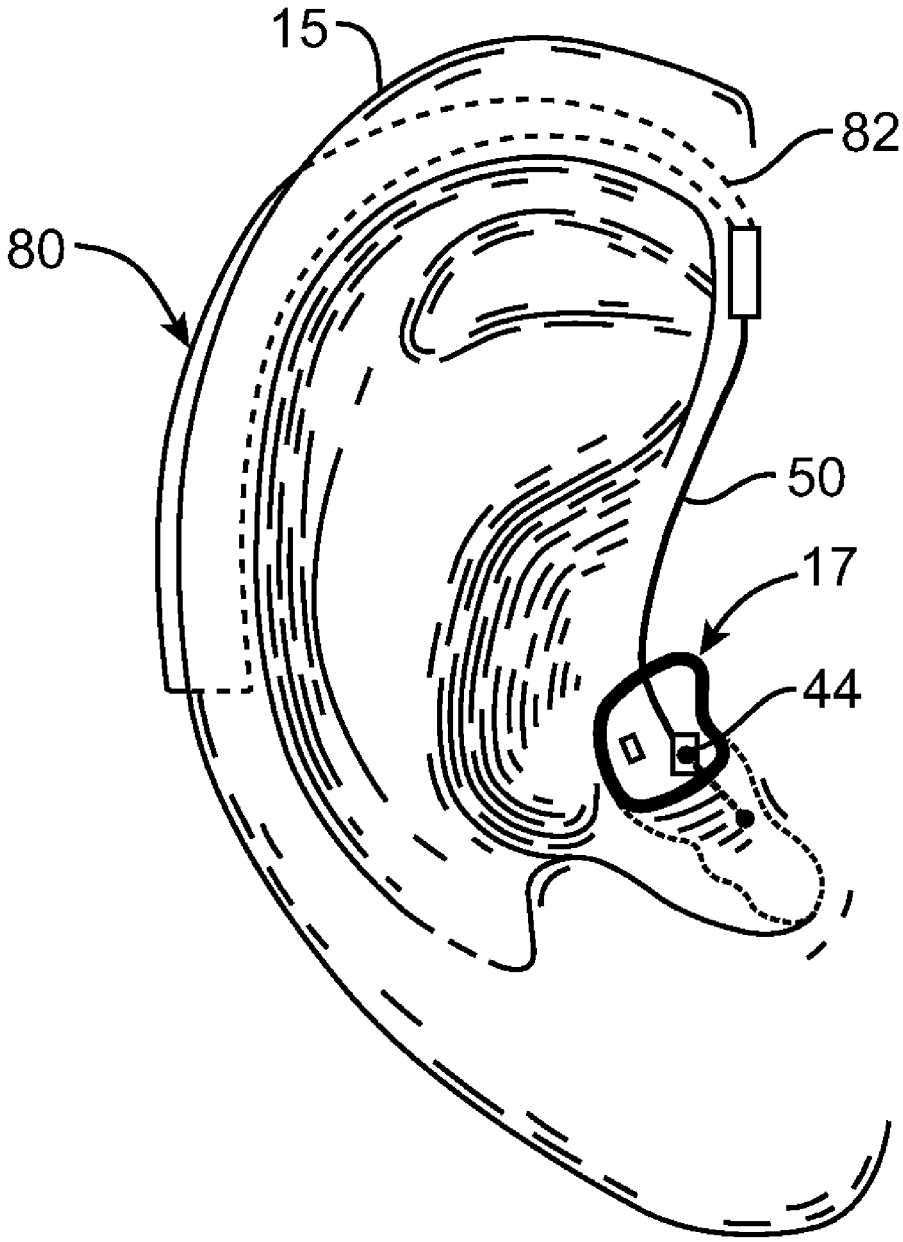
FIG. 1B shows a medial view of a hearing aid device as in FIG. 1A, according to embodiments of the present invention.

FIG. 1B shows a medial view of a hearing aid device as in FIG. 1A, according to embodiments of the present invention. A behind the ear (BTE) driver unit 80 includes electronic components coupled to microphone 44 and coil assembly 40, for example amplifiers, a digital signal processor (hereinafter "DSP") unit and batteries. Thus, the amplifiers, DSP unit and batteries are located external to the ear canal to leave the ear canal open. Driver unit 80 includes an ear hook 82 that attaches near the top of pinna 15. Driver unit 80 is connected to elongate support 50. As shown in FIGS. 1A and 1B, sound entering the ear canal is captured by microphone 44 and then sent to the DSP unit located in driver unit 80. Once the signal is processed by the DSP unit, the signal is delivered to coil assembly 40. Although driver unit 80 is shown to extend slightly beyond an outer boundary pinna 15 so as to be visible from the side of the user, driver unit 80 can be made compact to fit within the outer boundary of pinna 15 so that the driver unit is not visible from the side of the user.

Figure 1C:
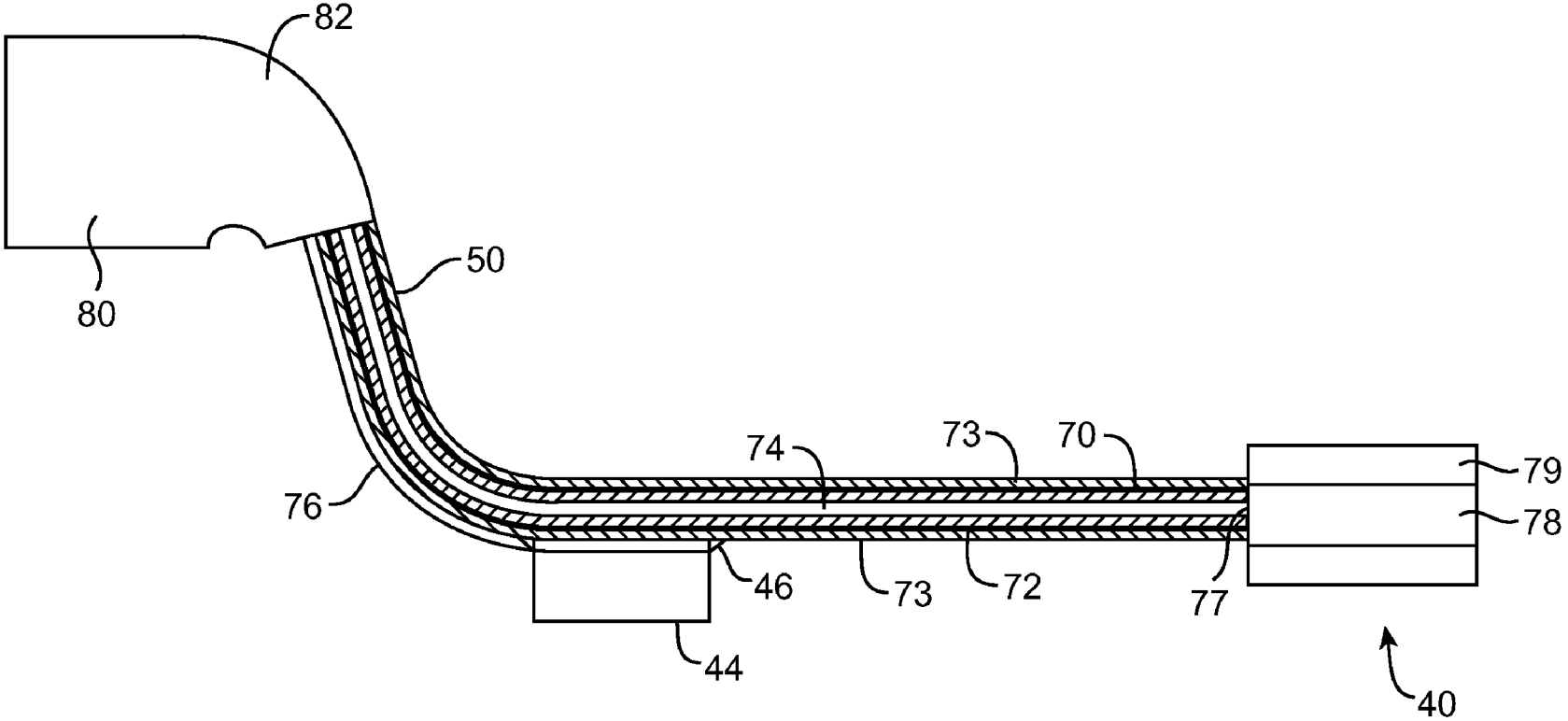
FIG. 1C shows a schematic illustration of a hearing aid device as in FIGS. 1A and 1B in greater detail, according to embodiments of the present invention.

FIG. 1C shows a schematic illustration of a hearing aid device as in FIGS. 1A and 1B in greater detail. Support 50 extends from ear hook 82 of driver unit 80 to coil assembly 40. Support 50 has embedded therein a wire 70 and a wire 72. Wire 70 and wire 72 are electrically connected to coil assembly 40 to drive coil assembly 40 with electrical current. Coil assembly 40 includes a core 78 and a coil 79. Coil 79 comprises several turns of wire wrapped around core 78. Wire 70 and wire 72 are shielded with a shielding 73. Shielding 73 is an electrical conductor attached to support 50. Shielding 73 can be formed in any number of known ways including braided wire and thin metallic tubing positioned over wire 70 and wire 72 to attenuate, and ideally eliminate, electromagnetic interference emanating from wire 70 and wire 72 that can interfere with the signal from microphone 44. In addition or in combination with shielding 73, wires 70 and 72 can be twisted to form a twisted pair. Shielding 73 also includes a biocompatible coating to protect the ear and elongate support 50. Microphone 44 is attached to support 50 with adhesive 46 as described above. At least one wire 76 extends from microphone 44 to provide an audio signal to driver unit 80. At least one wire 76 comprises a twisted pair of wires to reduce sensitivity noise. Although the wires are twisted to minimize electromagnetic interference from the wires carrying current to the coil, other noise reducing schemes can be employed, for example shielding. One of the wires can be used to supply batter power to the microphone. At least one wire 76 is shown external to elongate support 50 in FIG. 1C. In alternate embodiments at least one wire 76 is embedded within external support 50. In alternate embodiments microphone 44 is connected to wire 72 while 72 provides a reference ground voltage, and at least one wire 76 comprises one wire that transmits an electrical audio signal from microphone 44. Elongate support 50 also comprises a resilient member 74.

Resilient member 74 has properties that provide improved patient comfort with elongate support 50. The mechanical properties of elongate support 50 are substantially determined by the properties of resilient member 74, for example resilience, flexure and deformation properties. Resilient member 74 is elastically flexible in response to small deflections, such as patient chewing and other patient movements. Additionally, resilient member 74 can be deformed to a desired shape that matches the user's ear canal with larger deflections so as to permit resilient member 74 to be deformed to a shape that corresponds to the user's ear canal so as to avoid frictional contact between coil assembly 40 and the user's ear. In addition resilient member 74 is formed from a heat conducting material to transport heat away from core 78, for example metal and/or carbon materials. One ordinary skill can select appropriate materials with appropriate shapes to provide resilient member 74, for example wires of appropriate gauge and material.

Resilient member 74 conducts heat away from core 78 and out of the ear canal to provide improved patient comfort. As illustrated in FIG. 1C, resilient member 74 extends beyond opening 17 to ear hook 82 of driver unit 80. Resilient member 40 attaches to core 78 at attachment locus 77. Attachment locus 77 is adapted to conduct heat from core 78 to resilient member 74. For example attachment locus 77 can comprise a metallic weld, solder, or a thin layer of heat conducting adhesive material to promote heat conduction through the attachment locus. In an alternate embodiment, resilient member 74 and core 78 are formed from the same piece of material; this improves heat conduction and decreases the probability of device failure caused by separation of resilient member 74 from core 78. In alternate embodiments, wires 70 and 72 are resilient support members formed of resilient metal to provide resilient support, in a manner similar to that described above with respect to resilient member 74. Alternatively, wires 70 and 72 can be sized to provide very little support, for example with wires having a small diameter. In another embodiment, the resilient support is disposed near the outside of the elongate support and comprises resilient tubing.

Figure 1D:
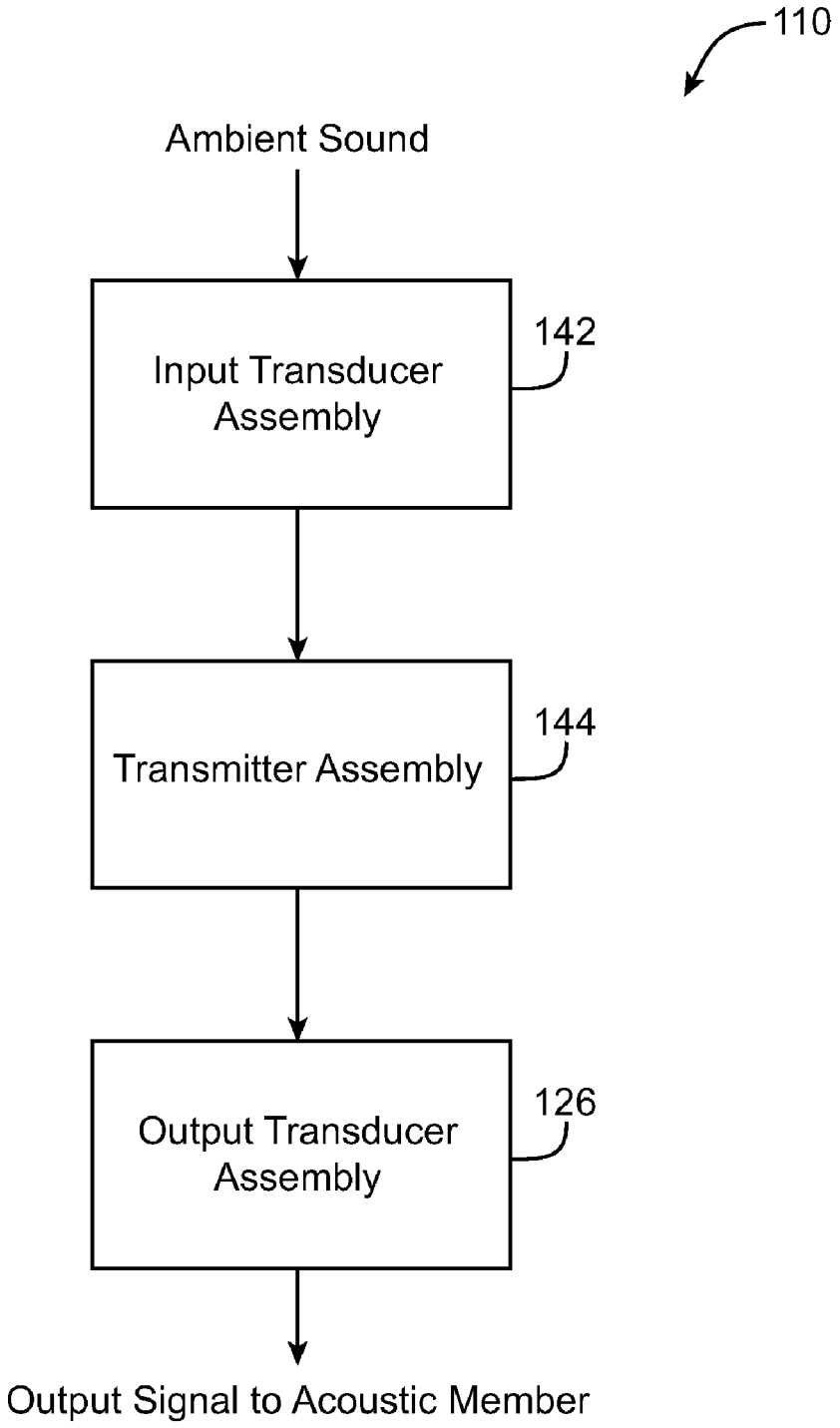
FIG. 1D shows a simplified schematic illustration of a hearing system that includes an in input transducer assembly, a transmitter assembly, and an output transducer assembly, according to embodiments of the present invention.

FIG. 1D shows a simplified schematic illustration of a hearing system 110 that includes an in input transducer assembly 142, a transmitter assembly 144, and an output transducer assembly 126, according to embodiments of the present invention. Input assembly 142 includes microphone 44, and transmitter assembly 144 can include a processor to process signals from microphone 44 and may include the energy delivery transducer, for example coil assembly 40. Output transducer assembly 126 includes permanent magnet 28. In some embodiments, output transducer assembly 126 may comprise the energy delivery transducer, for example coil assembly 40. Input transducer assembly 142 will receive a sound input, typically either ambient sound, for example microphone 44 in the case of hearing aids for hearing impaired individuals, or an electronic sound signal from a sound producing or receiving device, such as the telephone, a cellular telephone, a radio, a digital audio unit, or any one of a wide variety of other telecommunication and/or entertainment devices. Input transducer assembly 142 sends a signal to transmitter assembly 144 where transmitter assembly 144 processes the signal to produce a processed signal which is modulated in some way, to represent or encode a sound signal which substantially represents the sound input received by the input transducer assembly 142. The exact nature of the processed output signal will be selected based on the output transducer assembly 126 to provide both the power and the signal so that the output transducer assembly 126 can produce mechanical vibrations, acoustical output, pressure output, (or other output) which, when properly coupled to a user's hearing transduction pathway, will induce neural impulses in the user which will be interpreted by the user as the original sound input, or at least something reasonably representative of the original sound input.

In the case of hearing aids, input transducer assembly 142 typically comprises microphone 44 attached to elongate support 50 as described above. While it is possible to position the microphone behind the pinna, in the temple piece of eyeglasses, or elsewhere on the user, it is preferable to position the microphone within the ear canal (as described in copending application "Hearing System having improved high frequency response", 11/121,517 filed to May 3, 2005, the full disclosure of which has been previously incorporated herein by reference). Suitable microphones are well known in the hearing aid industry and are amply described in the patent and technical literature. The microphones will typically produce an electrical output that is received by the transmitter assembly 144, which in turn will produce a processed digital signal. In the case of ear pieces and other hearing systems, the sound input to the input transducer assembly 142 will typically be electronic, such as from a telephone, cell phone, a portable entertainment unit, or the like. In such cases, the input transducer assembly 142 will typically have a suitable amplifier or other electronic interface which receives the electronic sound input and which produces a filtered electronic output suitable for driving the transmitter assembly 144 and output transducer assembly 126.

Transmitter assembly 144 typically comprises a digital signal processor, also referred to as a DSP unit 150, that processes the electrical signal from the input transducer and delivers a signal to a transmitter element that produces the processed output signal that actuates the output transducer assembly 126. The transmitter element that is in communication with the digital signal processor is in the form of coil assembly 40. A power source, for example a battery 155 comprised within the transmitter assembly, is coupled to the assemblies to provide power, for example coupled to the coil assembly to supply a current to the coil assembly. The current delivered to the coil assembly will substantially correspond to the electrical signal processed by the digital signal processor. One useful electromagnetic-based assembly is described in commonly owned, copending U.S. patent application Ser. No. 10/902,660, filed Jul. 28, 2004, entitled "Improved Transducer for Electromagnetic Hearing Devices," the complete disclosure of which is incorporated herein by reference. As can be appreciated, embodiments of the present invention are not limited to coil transmitter assemblies. A variety of different transmitter assemblies may be used with the hearing systems of the present invention, for example ultrasound transmitter assemblies and optical transmitter assemblies as described in, U.S. Pat. App. No. 60/702,532, filed on Jul. 25, 2006, entitled "Light-Actuated Silicon Sound Transducer" the full disclosure of which has been previously incorporated by reference.

Figure 1E:
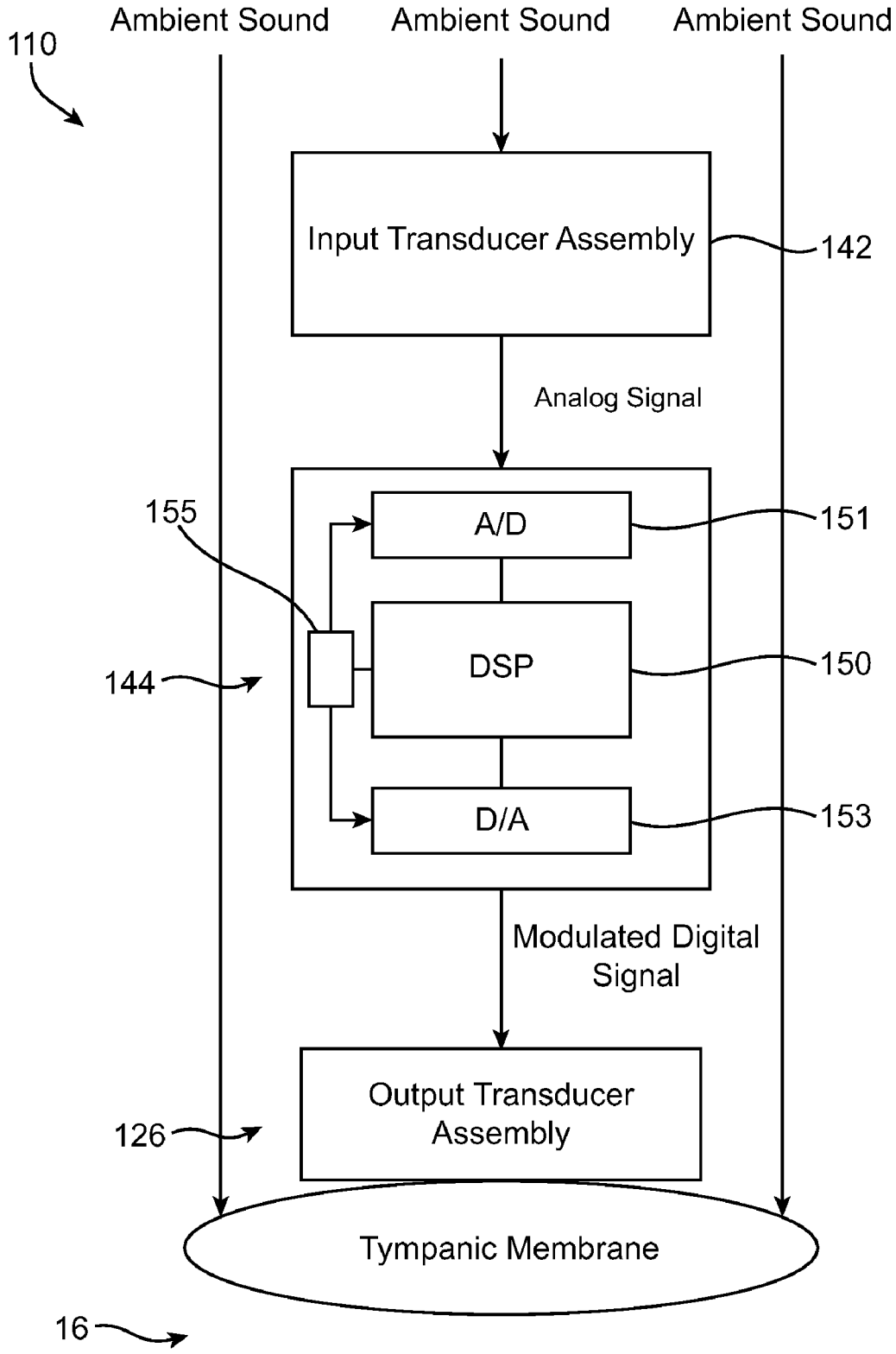
FIG. 1E is a more detailed schematic illustration of a hearing system as in FIG. 1D, according to embodiments of the present invention.

FIG. 1E is a more detailed schematic illustration of a hearing system 110 as in FIG. 1D, according to embodiments of the present invention. In such embodiments, some of the ambient sound entering the auricle at ear canal opening 17 is captured by the input transducer assembly 142 (e.g., microphone) that is positioned within ear canal opening 17. Input transducer assembly 142 converts sound waves into analog electrical signals for processing by a digital signal processor (DSP) unit 150 of transmitter assembly 144. DSP unit 150 may optionally be coupled to an input amplifier (not shown) to amplify the electrical signal. DSP unit 150 typically includes an analog-to-digital converter 151 that converts the analog electrical signal to a digital signal. The digital signal is then processed by any number of conventional or proprietary digital signal processors and filters 150. The processing may comprise of any combination of frequency filters, multi-band compression, noise suppression and noise reduction algorithms. The digitally processed signal is then converted back to analog signal with a digital-to-analog converter 153. The analog signal is shaped and amplified and sent to a transmitter element (such as a coil), which generates a modulated electromagnetic field containing audio information representative of the original audio signal and, directs the electromagnetic field toward the output transducer assembly 126 that comprises distributed activatable elements, for example magnet 28 coupled to coil assembly 40. Output transducer assembly 126 induces vibrations in the ear.

Figure 2A:
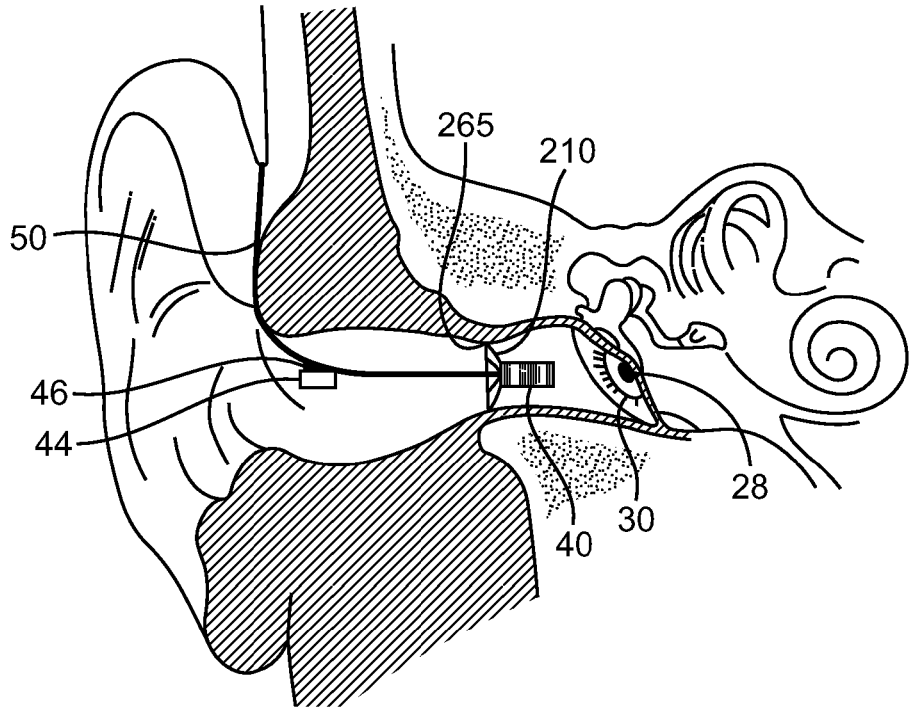
FIG. 2A shows a positioner attached to an elongate support near a transducer, in which the positioner is adapted to contact the ear in the canal near the transducer and support the transducer, according to embodiments of the present invention.

As noted above, the hearing system 110 of embodiments of the present invention may incorporate a variety of different types of input/output transducer assemblies 142, 126 and transmitter assemblies 144. Thus, while the examples of FIGS. 1A and 2A illustrate electromagnetic signals, the hearing systems of the present invention also encompass assemblies which produce other types of signals, such as acoustic signals, pressure signals, optical signals, ultra-sonic signals, infrared signals, or the like. In some embodiments, pulse-width modulation can be used, for example without digital to analog converter 153, to drive output transducer assembly 126. In such embodiments, the digital signal from DSP 150 can be pulse-width modulated so as to encode the signal transmitted to output transducer assembly 126 based on the widths of pulses in the transmitted signal.

The various elements of the hearing system 110 may be positioned anywhere desired on or around the user's ear. In some configurations, all of the components of hearing system 110 are partially disposed or fully disposed within the user's auditory ear canal 11. For example, in one preferred configuration, the input transducer assembly 142 is positioned in the auditory ear canal so as to receive and retransmit the low frequency and high-frequency three dimensional spatial acoustic cues. If the input transducer assembly was not positioned within the auditory ear canal, (for example, if the input transducer assembly is placed behind-the ear (BTE)), then the signal reaching its input transducer assembly 142 may not carry the spatially dependent pinna cues, and there is little chance for there to be spatial information particularly in the vertical plane. In other configurations, however, it may be desirable to position at least some of the components behind the ear or elsewhere on or around the user's body, for example transmitter assembly 144 may be positioned behind the ear as shown above with reference to the driver unit.

FIG. 2A shows a positioner attached to an elongate support near a transducer, in which the positioner is adapted to contact the ear in the canal near the transducer and support the transducer, according to embodiments of the present invention. A wide support 210 is attached to elongate support 50 near coil assembly 40. Positioner 210 is used to center the coil in the canal to avoid contact with skin 265, and also to maintain a fixed distance between coil assembly 40 and magnet 28. Positioner 210 is adapted for direct contact with a skin 265 of ear canal 11. For example positioner 210 includes a width that is approximately the same size as the cross sectional width of the ear canal where the positioner contacts skin 265. Also, the width of positioner 210 is typically greater than a cross-sectional width of coil assembly 40 so that the positioner can suspend coil assembly 40 in the ear canal to avoid contact between coil assembly 40 and skin 265 of the ear canal.

Positioner 210 is adapted for comfort during insertion into the user's ear and thereafter. Positioner 210 is tapered proximally (and laterally) toward the ear canal opening to facilitate insertion into the ear of the user. Also, positioner 210 has a thickness transverse to its width that is sufficiently thin to permit positioner 210 to flex while the support is inserted into position in the ear canal. However, in some embodiments the positioner has a width that approximates the width of the typical ear canal and a thickness that extends along the ear canal about the same distance as coil assembly 40 extends along the ear canal. Thus, as shown in FIG. 2A positioner 210 has a thickness no more than the length of coil assembly 40 along the ear canal.

Positioner 210 permits sound waves to pass and provides and can be used to provide an open canal hearing aid design. Positioner 210 comprises several spokes and openings formed therein. In an alternate embodiment, positioner 210 comprises soft "flower" like arrangement. Positioner 210 is designed to allow acoustic energy to pass, thereby leaving the ear canal mostly open.

Figure 2B:
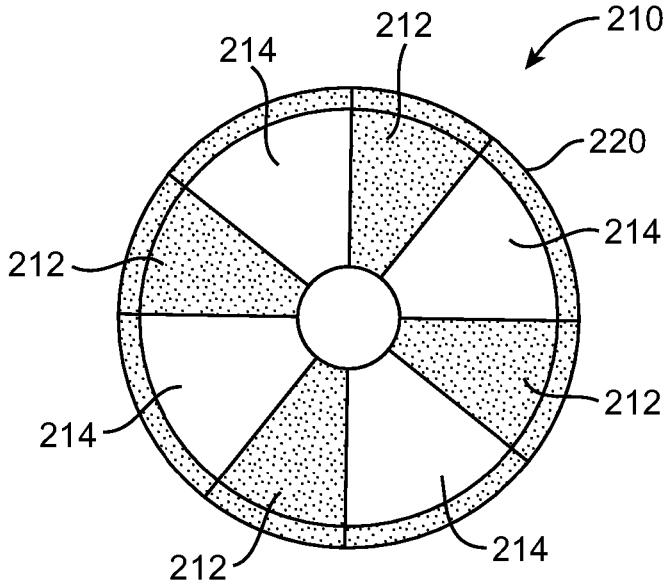
FIG. 2B shows a positioner as in FIG. 2A in detail, according to embodiments of the present invention.

FIG. 2B shows a positioner as in FIG. 2A in detail, according to embodiments of the present invention. Positioner 210 comprises flanges, or spokes 212, and an annular rim 220. Spokes 212 and annular rim 220 define apertures 214. Apertures 214 are shaped to permit acoustic energy to pass. In an alternate embodiment, the rim is elliptical to better match the shape of the ear canal defined by skin 265. Also, the rim can be removed so that spokes 212 engage the skin in a "flower petal" like arrangement. Although four spokes are shown, any number of spokes can be used. Also, the apertures can be any shape, for example circular, elliptical, square or rectangular.

Figure 3:
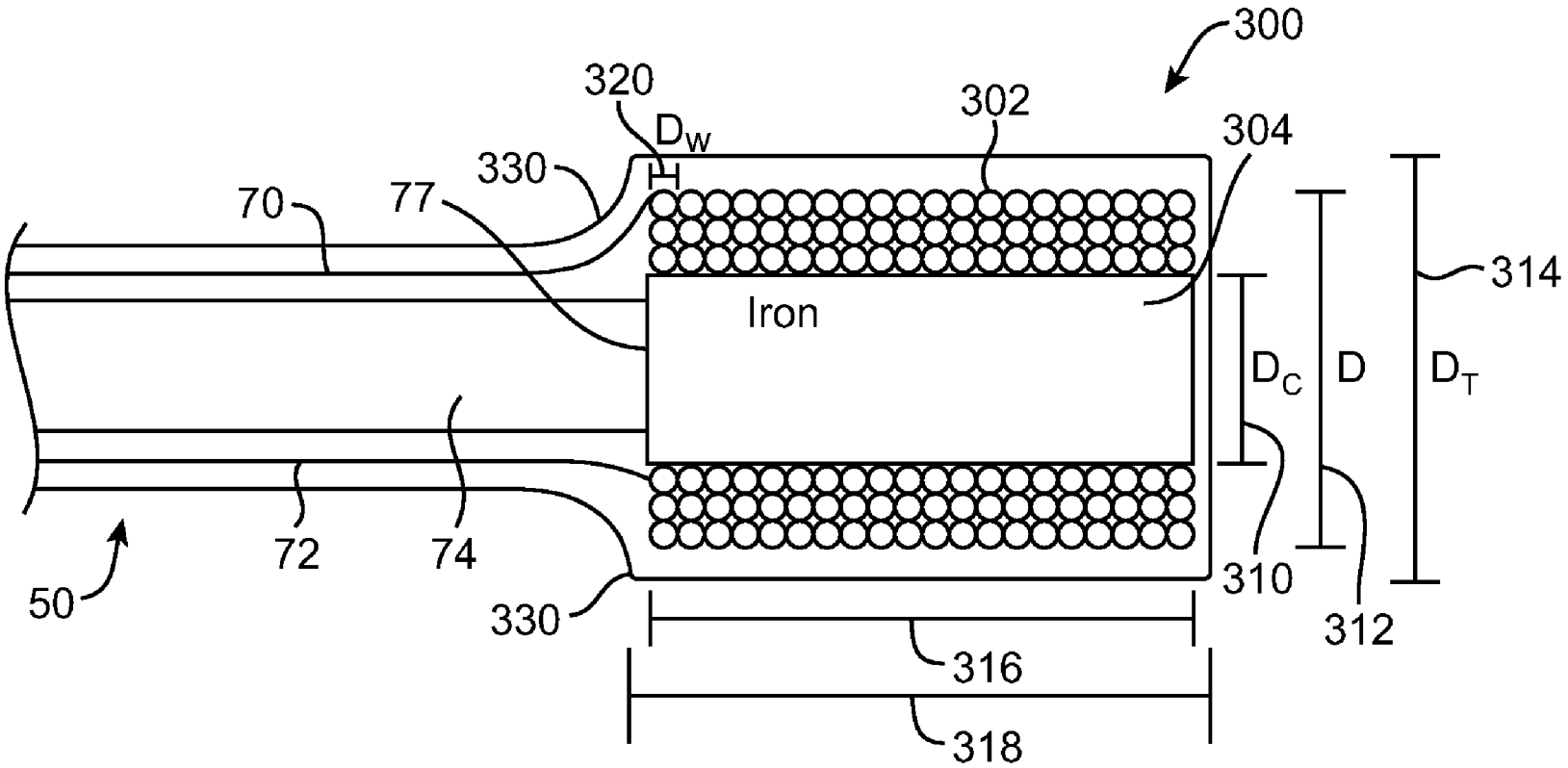
FIG. 3 shows transducer comprising a coil of wire wrapped around an iron core, according to embodiments of the present invention.

FIG. 3 shows a coil assembly 300, similar to the coil assembly described above, comprising a coil 302 of wire wrapped around an iron core 304, according to embodiments of the present invention. A core diameter 310 (herein after "$D_c$") is a diameter across core 304, and a coil diameter 312 (hereinafter "D") is the diameter across the coil. Coil assembly 300 is coated with a biocompatible coating 330. The total diameter (hereinafter "$D_t$") of the coil assembly includes a dimension across the coated coil. The total number of turns (hereinafter "N") of the coil is formed by multiple layers of the wire. The total number of layers (hereinafter "m") of wire indicates the number of layers of wire used, for example three layers as shown in FIG. 3. The coil and core have a length 316 (herein after "$L_c$"). Although the length of the coil and core are the same as shown in FIG. 3, the core and coil can have different lengths. The coated coil assembly has a length 318 that is slightly larger than length 316. The wire wrapped around the core has a diameter 320 (hereinafter "$D_w$"). Although the core of the embodiment shown in FIG. 3 is made mainly of Iron, other core materials, such as alloys and ferromagnetic materials can be used. In alternate embodiments, the coil assembly is provided with a coil of wire without a central core.

Coil Assembly Coating Material

Once the coil assembly described above is manufactured, it is coated with a biocompatible material. This coating has several functions. One is to make the coil assembly biocompatible. The coil assembly material includes copper wires and possibly a ferrite core are these materials are not generally biocompatible. To protect the user from the coil assembly material and/or products of corrosion, the coil assembly is sealed with a coating that comprises a biocompatible material. The coating also keeps various ions, such as chloride ions that are formed when common salts are mixed with water, from corroding the coil assembly. Since the coil assembly will be potentially in contact with the skin, this contact can result in adverse conditions such as frictional irritation. The coating material is chosen to also minimize friction. Such materials include but are not limited to silicone, rubber, acrylic, epoxy, and polyethylene. All of these coating materials are non magnetic which is also beneficial. Another reason to coat the coil assembly is to ensure that the coil wires remain intact as coated wires are less susceptible to damage.

Reduction of Coil Assembly Generated Heat

Current carrying wires generate heat due to the finite resistance in wires. Normally, the generated heat is sufficiently low so that the coil assembly temperature is not very different from body temperature. Under some conditions, for example the conditions of high level and continuous current stimulation, the coil assembly temperature may become elevated above the body temperature of the user, for example a typical body temperature. If the temperature is too high the elevated temperature may cause discomfort, and in extreme cases the user may spontaneously remove the device and stop using it. To minimize this potentially adverse condition, it is desirable to have a heat conducting material along the elongate support that allows heat generated by the coil assembly to be transported away by diffusion. One end of the heat conducting material is in contact with the core or coil while the other end is directed towards the ear canal opening and can extend beyond the canal opening. The heat conducting transport material can be formed as a wire along a core of the elongate support, for example a resilient member as described above, or the heat conducting transport material can be formed as a twisted cable. In alternate embodiments, the heat conducting transport material can be formed as a coating on the outside of the elongate support and coil. The heat conducting transport material can comprise any suitable material for example aluminum, silver, gold, carbon, or any other material with a relatively high heat conductivity.

Flexible Transducer Scaffolding

The elongate support functions as a flexible scaffolding used to hold the coil assembly and microphone. The elongate support is flexible enough to accommodate a bend in the ear canal and rigid enough to hold the transducers in a fixed position. Thus large deformations of the support allow the elongate support to maintain a prescribed curvature, while small deformations result in resilient deformation of the support. This flexibility is also useful for insertions of the device in the canal where the user first deforms the unit to make it easier to put it in.

Subject Specific Support Length

For a given magnetic field generated at the core tip, the field intensity decreases as distance increases. Thus it is desirable to have the medial end of coil assembly 40 be close to magnet 28. However, if the medial end of coil assembly 40 is too close to magnet 28 the static force due to the ferrite core will have a tendency to pull magnet 28 away from the tympanic membrane. If the distance is too far then the effective output of magnet 28 is reduced. Work in relation with embodiments of the present invention suggests that the optimal distance between the medial/distal end of the core of coil assembly 40 and magnet 28 is within a range of about 2 to 6 mm, for example about 4 mm. As the ear canal length can vary from user to user, an ear surgeon uses a measurement instrument to determine the ear canal length from the opening on the lateral end of the canal to the tympanic membrane on the medial end of the canal. Alternatively, as the ear canal length is correlated to other anatomical features such as head size and/or body weight, the other anatomical features can be measured to approximately determine the length of the ear canal. This information can then be used to determine the length of elongate support 50 and the location of microphone 44 for each individual user.

Microphone Location

The location of microphone 44 along elongate support 50 is determined by at least two factors. First, to minimize acoustic feedback from magnet 28, it is desirable to place the microphone as lateral as possible toward the ear canal opening so that the microphone is far from the magnet. Work in relation to embodiments of the present invention suggests that magnetically coupled hearing aids can produce feedback because the magnet positioned on the tympanic membrane can drive the tympanic membrane as a speaker to produce sound which emanates from the tympanic membrane. Thus, although feedback is reduced with magnetically coupled hearing aids, some feedback can occur if the microphone is too close to the tympanic membrane. Second, to ensure that high frequency sound localization cues are present at the microphone location, it is desirable to place the microphone in the ear canal or at least near the ear canal opening, for example in the ear canal and within about 6 mm of the opening to the ear canal. In some embodiments, the high frequency spatial localization cues are present even if the microphone is located slightly outside the ear canal, for example outside the ear canal and within about 6 mm of the ear canal opening.

Ear Canal Gain

Studies have shown that the transfer of sound from the canal opening to the eardrum varies with frequency. This transfer function is compensated in the signal from the output amplifier stage of the system. Around 4 kHz there is 14 dB gain in pressure due to the canal resonance. Above and below 4 kHz the gain decreases towards 0 dB. At near 12 kHz there is a second resonant peak of about 10 dB. The resonant frequencies and gain levels are user dependent. Thus, in some embodiments, for example with the microphone near the ear canal opening, the ear canal to eardrum pressure gain of the output stage is measured and corrected based on the transfer function, in a user specific manner. Such corrections can be made with the DSP unit, as described above. In some embodiments, placement of the microphone closer to the eardrum can avoid having to measure the gain and thus avoid having to compensate it, which has practical advantages.

Coil Design

The coil assembly can be optimized to provide the best possible combination of sound output, efficiency, size, ease of fitting and comfort. In addition, there are many constraints placed on the coil assembly design. The overall system operates with a limited battery voltage and limited available current. In some embodiments, rechargeable batteries provide the battery voltage and current. Coil performance parameters of interest include the maximum B field output of the system at the specified current and voltage maximums, and the B-field per unit of current (hereinafter "B/I"). The B/I parameter should be maximized to improve efficiency, as higher B/I indicates a more efficient system and thus longer battery life for the system. Additional relevant design parameters to consider include battery voltage, maximum coil current, and coil inductance, which is related to the desired bandwidth. High frequency requirements can result in high coil impedance. To overcome this, a higher voltage battery can be used to generate adequate current at the higher frequencies. Some prior coil assembly designs have used a 1.5-volt standard battery. Embodiments of the present invention use the higher voltage of rechargeable batteries, which are typically 3.7 volts to provide an optimized coil design.

Sizes and shapes of coil assemblies that can be easily put into the ear canal are limited. Since the typical ear canal has an elliptical shape with minor axis dimension of about 4 mm, the maximum allowable diameter of the coil assembly can be about 3.5 mm in some embodiments. The extra 0.5 mm can be reserved for external coatings, for example biocompatible coatings as described above, and other factors, such that the final coil assembly, with coating, comprises a width of about 4 mm. In many embodiments, the coil assembly comprises a width from about 1 to about 4 mm, for example from about 3.2 to about 4.2 mm. As ear canals can have a tortuous nature, long coil assemblies can result in insertion difficulties. Work in relation with embodiments of the present invention suggests that a length of about 4 mm is suitable to navigate a tortuous ear canal and also provide enough room for the wire turns, although other lengths can be used for example lengths from about 3 to 6 mm.

The analytical framework described above and with respect to FIG. 3 can be used to optimize the size and shape of the coil in accordance with embodiments of the present invention. For example a mathematical model has been developed to analyze the effect of different wire gauges and core sizes. For with a core having a length of about 3.5 mm, 46-gauge wire has a resistance per unit length that is high and is thus not suitable for use in some embodiments, for example a 3 volt system. On the other hand, 34-gauge wire has a large diameter and may not provide enough turns to generate a suitable magnetic field in the small space of the ear canal and is thus not suitable for use with some embodiments of the present invention. The analysis described herein below indicates that a limited range of wire gauges can be selected to provide a suitable coil with the desired dimensions and electromagnetic properties.

Figures 4A, 4B:
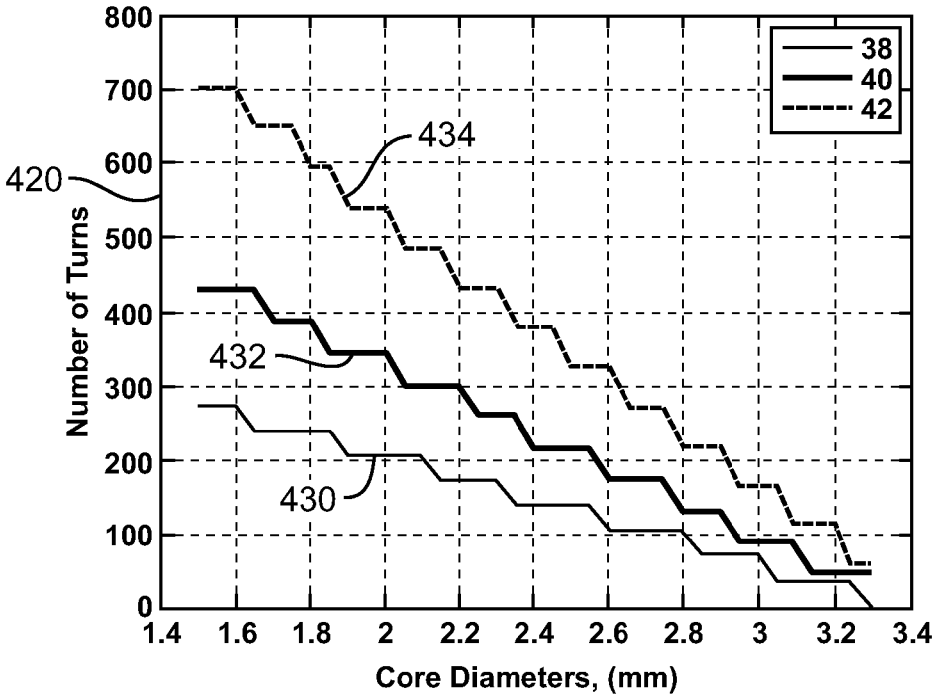
FIG. 4A shows a table of coil design parameters shown to provide suitable coil characteristics including suitable coil diameters and wire gauges, according to embodiments of the present invention.
FIG. 4B shows the number of wire turns available for a coil assembly having parameters as shown FIG. 4A, according to embodiments of the present invention.

FIG. 4A shows a table of coil design parameters with suitable coil characteristics, including suitable coil diameters and wire gauges, according to embodiments of the present invention. A column shows parameters 410 and values 412 that provide suitable results, for example a coil diameter of 3.5 mm, a core length of 4 mm, a distance from medial core tip to driven magnet (hereinafter "z") of 4 mm, and wire gauges from 38 to 42 AWG. Core thicknesses from about 0.5 to 3.3 mm have been evaluated, and the core thickness may comprise many values within this range, for example from about 1.5 to 3.3 mm. Additional parameters selected to evaluate the performance of a coil include an RMS voltage of 1.77 V, a maximum current of 300 mA, and frequency of 8 kHz. As is explained below, for a coil diameter sized to about 3.5 mm to fit into the ear canal, the core is limited to a maximum size of about 3.1 mm.

FIG. 4B shows the number of wire turns available for a coil assembly having parameters as shown FIG. 4A, according to embodiments of the present invention. The number of turns 420 is shown as a function of a core diameter 422, with wire gauge as a parameter. The plots shown include a 38 gauge plot 430, a 40 gauge plot 432 and a 42 gauge plot 434. The plots shown are for a core diameter range from about 1.4 to 3.4 mm. As the core diameter increases, the number of turns that can fit inside the maximum diameter decreases. The stair-step appearance to the graph is due to the discrete nature of the number of wire layers that can fit. Each jump corresponds to a new layer of wire that can fit in the ear canal.

Another constraint on the core diameter is the B field at the location of the magnet, which can be chosen to be about 4 mm from the medial end of the core tip, as shown for the value of the "z" parameter in FIG. 4A. In comparison with larger core diameters, smaller core diameters spread out the B field more as one moves away from the core axis. As a result larger cores are less sensitive than smaller cores to alignment errors between the core and permanent magnet. Although smaller cores provide more turns, better alignment of a smaller core with magnetic axis may be needed, or a decreased B field at the magnet may result. Calculations suggest that core diameters above about 1.8 mm are adequate without requiring significant alignment with the permanent magnet. On the upper end, the ear canal anatomy can constrain the core diameter to below about 3.1 mm, as will be appreciated with reference to FIG. 4B.

Figure 5A:
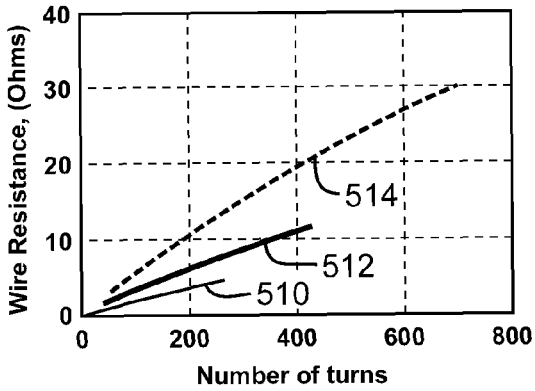
FIGS. 5A to 5F show coil properties for a coil assembly having parameters as shown in FIG. 4A, according to embodiments of the present invention.
Figure 5B:
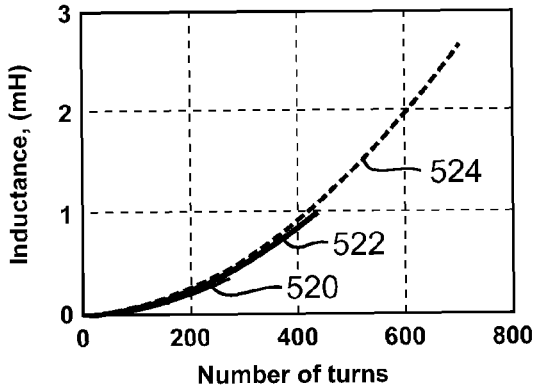
Figure 5C:
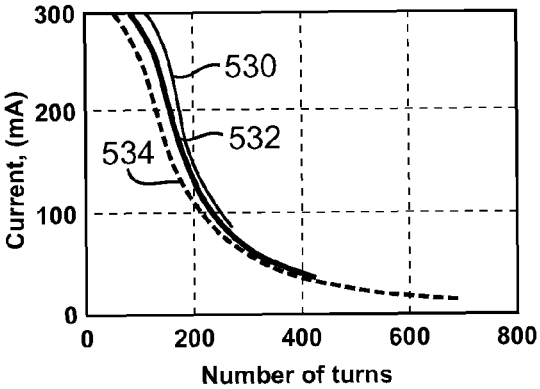
Figure 5D:
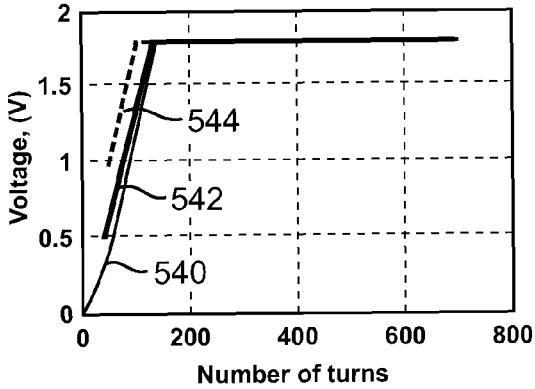
Figure 5E:
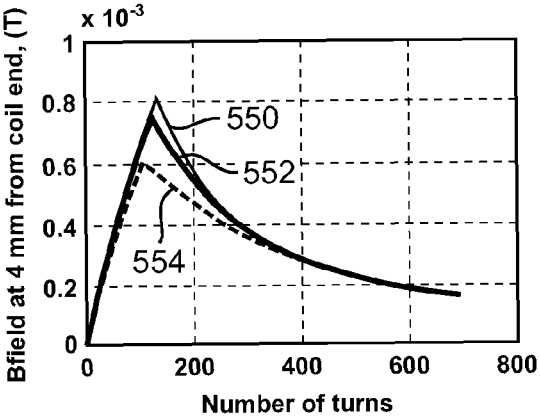
Figure 5F:
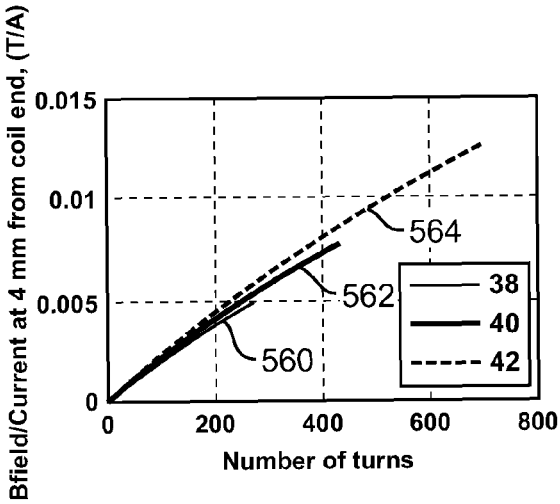

FIGS. 5A to 5F show coil properties for a coil assembly having parameter values as shown in FIG. 4A, according to embodiments of the present invention. The properties are shown as plots for parameters that include number of coil turns and wire gauge. FIG. 5A shows plots of coil resistance (Ohms) versus number of turns, including a plot 510 for 38 gauge wire, a plot 512 for 40 gauge wire and a plot 514 for 42 gauge wire. FIG. 5B shows plots of coil inductance (mH) versus number of turns, including a plot 520 for 38 gauge wire, a plot 522 for 40 gauge wire and a plot 524 for 42 gauge wire. The inductance increases as the square of the number of turns. FIG. 5C shows plots of coil current (mA) versus number of turns, including a plot 530 for 38 gauge wire, a plot 532 for 40 gauge wire and a plot 534 for 42 gauge wire. FIG. 5D shows plots of coil Voltage (V) versus number of turns, including a plot 540 for 38 gauge wire, a plot 542 for 40 gauge wire and a plot 544 for 42 gauge wire. FIG. 5E shows plots of coil B field (T) at 4 mm from the medial end of the core versus number of turns, including a plot 550 for 38 gauge wire, a plot 552 for 40 gauge wire and a plot 554 for 42 gauge wire. The B field reaches a maximum for the 38-gauge wire. FIG. 5F shows plots of a ratio of B field to current (T/A) versus number of turns, including a plot 560 for 38 gauge wire, a plot 562 for 40 gauge wire and a plot 564 for 42 gauge wire. As explained above, the ratio of B field to current ("B/I") indicates the efficiency of the coil. The efficiency (B/I) increases as the number of turns increases. However, the B field reaches a maximum value between about 100 and 150 turns, depending on the gauge of wire. Thus, there is a tradeoff between maximum B field and maximum efficiency.

FIG. 6 shows coil characteristics and tradeoffs in the design variables for three different coils with 4 mm length cores, according to embodiments of the present invention. Parameters 610 include wire gauge, number of turns, core diameter, resistance, inductance, maximum B field at 4 mm at 8 kHz, and ratio of maximum B field at 4 mm at 8 kHz to current. Coil #1, coil #2 and coil #3 have parameter values listed in columns 620, 630 and 640, respectively. Coil #4 has parameter values listed in column 650 and these values are shown for comparison. Coil #4 is much longer and has a core length of 15 mm.

Although coil #1, coil #2 and coil #3 each show acceptable results, coil number #3 provides an optimal design. Coil #3 provides a coil that can be placed in the ear canal and provide an open ear canal that permits sound waves to pass the coil. In addition coil #3 is short and thus does not require a rigid structure in the ear canal for anchoring, for example a rigid shell is not required. As indicated in the maximum B field and B/I rows, coil #3 is not significantly different from coil #4. Thus, a 4 mm coil can provide coil characteristics similar to a much longer 15 mm coil. The advantage is comparable system output with a significantly shorter coil assembly. Although the resistance for coil #3 is higher than coil #4 due to the smaller gauge wire used for coil #3, the inductance for coil #3 is lower than for coil #4.

Figure 7:
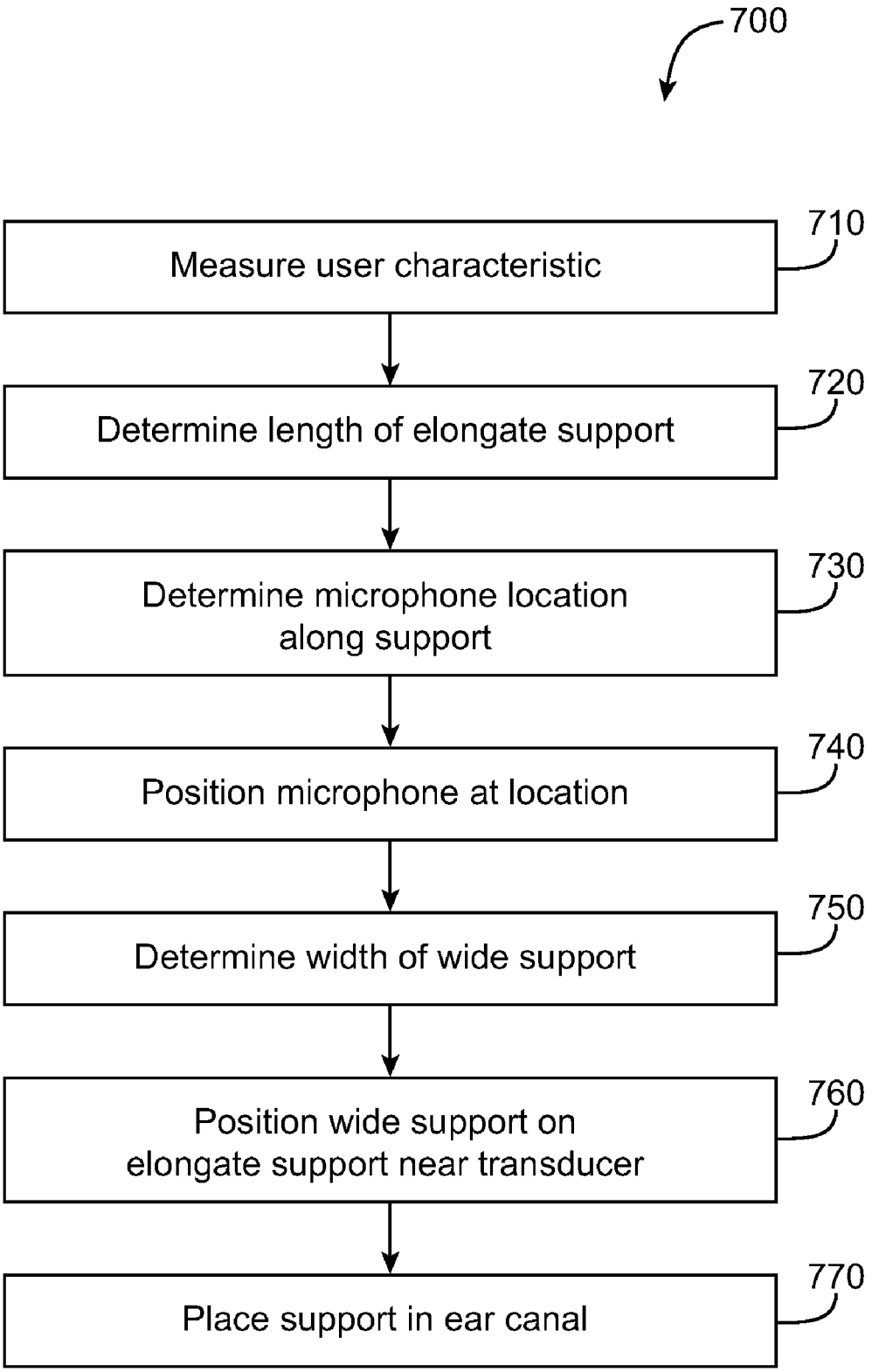
FIG. 7 shows a method of fitting and placing components of a hearing aid in an ear of a user, according to embodiments of the present invention.

FIG. 7 shows a method 700 of fitting and placing components of a hearing aid for an ear of a user, according to embodiments of the present invention. A step 710 measures a user characteristic correlated with a distance from the opening of an ear canal to the tympanic membrane, for example the actual distance from the ear canal opening to the tympanic membrane. A step 720 determines a length of an elongate support from the measured characteristic to position a transducer near the tympanic membrane while the support is placed in the ear. In some embodiments, the determined length of the elongate support positions the transducer from about 2 to 6 mm from the tympanic membrane. Also, the length of the elongate support can be determined to avoid contact with the ear between the microphone and the transducer. The length of the elongate support corresponds to the distance from the driver unit to the transducer, and additional patient characteristics can be measured, for example the length from the ear canal opening to the portion of the ear where the ear hook is placed. In some embodiments, the distance of the elongate support corresponds to a distance from the ear canal opening to the proximal end of the coil assembly. A step 730 determines a location of the microphone along the elongate support to place the microphone near the ear canal opening, for example within about 6 mm of the ear canal opening, while the transducer is placed near the tympanic membrane. The location of the microphone along the elongate support is determined from the measured patient characteristic. A step 740 positions the microphone at the location on the support. The microphone can be positioned at the location in response to the length of the elongate support, for example the length determined by step 720. A step 750 determines a width of a positioner for placement in the ear canal near the transducer, for example a width sized to contact the skin of the ear canal to support the transducer and avoid contact between the transducer and the ear. A step 760 positions the positioner on the elongate support near the transducer, for example the coil assembly. A step 770 places the elongate support, transducer and microphone in the ear canal.

It should be appreciated that the specific steps illustrated in FIG. 7 provide a particular method of fitting and placing components of a hearing aid for an ear of a user, according to an embodiment of the present invention. Other sequences of steps may also be performed according to alternative embodiments. For example, alternative embodiments of the present invention may perform the steps outlined above in a different order. Moreover, the individual steps illustrated in FIG. 7 may include multiple sub-steps that may be performed in various sequences as appropriate to the individual step. Furthermore, additional steps may be added or removed depending on the particular applications. One of ordinary skill in the art would recognize many variations, modifications, and alternatives.

Figure 8A:
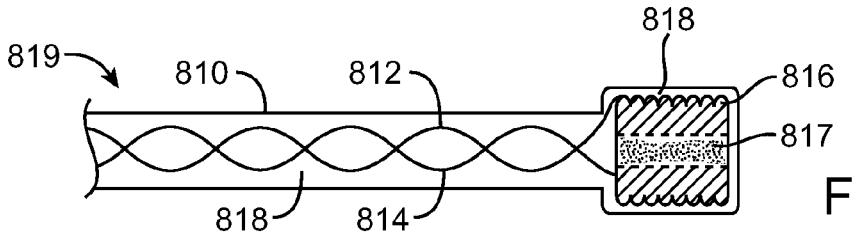
FIG. 8A shows an elongate support with a pair of positioners adapted to contact the ear canal and support the transducer, according to embodiments of the present invention.

FIG. 8A shows an elongate support with a pair of positioners adapted to contact the ear canal and support the transducer, according to embodiments of the present invention. An elongate support 810 extends to a coil assembly 819. Coil assembly 819 comprises a coil 816, a core 817 and a biocompatible material 818. Elongate support 810 includes a wire 812 and a wire 814 electrically connected to coil 816. Coil 816 can include any of the coil configurations as described above. Wire 812 and wire 814 are shown as a twisted pair, although other configurations can be used as described above. Elongate support 810 comprises biocompatible material 818 formed over wire 812 and wire 814. Biocompatible material 818 covers coil 816 and core 817 as described above.

Wire 812 and wire 814 are resilient members and are sized and comprise material selected to elastically flex in response to small deflections and provide support to coil assembly 819. Wire 812 and wire 814 are also sized and comprise material selected to deform in response to large deflections so that elongate support 810 can be deformed to a desired shape that matches the ear canal. Wire 812 and wire 814 comprise metal and are adapted conduct heat from coil assembly 819. Wire 812 and wire 814 are soldered to coil 816 and can comprise a different gauge of wire from the wire of the coil, in particular a gauge with a range from about 26 to about 36 that is smaller than the gauge of the coil to provide resilient support and heat conduction. Additional heat conducting materials can be used to conduct and transport heat from coil assembly 819, for example shielding positioned around wire 812 and wire 814.

Elongate support 810 and wire 812 and wire 814 extend toward the driver unit and are adapted to conduct heat out of the ear canal.

Figure 8B:
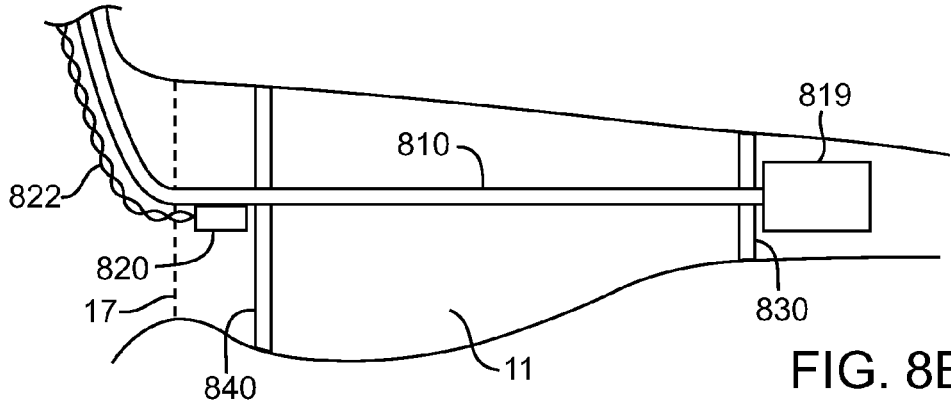
FIG. 8B shows an elongate support as in FIG. 8A attached to two positioners placed in an ear canal, according to embodiments of the present invention.

FIG. 8B shows an elongate support as in FIG. 8A attached to two positioners placed in an ear canal, according to embodiments of the present invention. A first positioner 830 is attached to elongate support 810 near coil assembly 819. First positioner 830 engages the skin of the ear canal to support coil assembly 819 and avoid skin contact with the coil assembly. A second positioner 840 is attached to elongate support 810 near ear canal opening 17. Second positioner 840 is sized to contact the skin of the ear canal near opening 17 to support elongate support 810. A microphone 820 is attached to elongate support 810 near ear canal opening 17 to detect high frequency sound localization cues. The positioners and elongate support are sized and shaped so that the supports substantially avoid contact with the ear between the microphone and the coil assembly. A twisted pair of wires 822 extends from microphone 820 to the driver unit and transmits an electronic auditory signal to the driver unit. Although microphone 820 is shown lateral to positioner 840, microphone 840 can be positioned medial to positioner 840. Elongate support 810 is resilient and deformable as described above. Although elongate support 810, positioner 830 and positioner 840 are shown as separate structures, the support can be formed from a single piece of material, for example a single piece of material formed with a mold. In some embodiments, elongate support 81, positioner 830 and positioner 840 are each formed as separate pieces and assembled. For example, the positioners can be formed with holes adapted to receive the elongate support so that the positioners can be slid into position on the elongate support.

Figures 1, 8B:
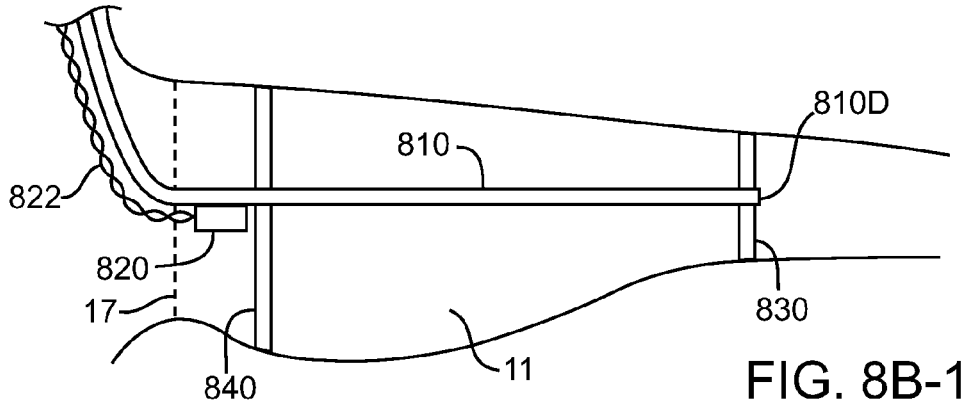
Figure 8C:
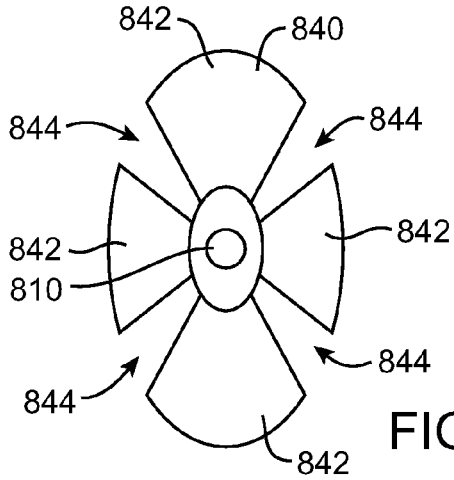
FIG. 8C shows a positioner adapted for placement near the opening to the ear canal, according to embodiments of the present invention.

FIG. 8C shows a positioner adapted for placement near the opening to the ear canal according to embodiments of the present invention. Positioner 840 includes flanges 842 that extend radially outward to engage the skin of the ear canal. Flanges 842 are formed from a flexible material. Openings 844 are defined by flanges 842. Openings 844 permit sound waves to pass positioner 840 while the positioner is positioned in the ear canal, so that the sound waves are transmitted to the tympanic membrane. Although flanges 842 define an outer boundary of support 840 with an elliptical shape, flanges 842 can comprise an outer boundary with any shape, for example circular. In some embodiments, the positioner has an outer boundary defined by the shape of the individual user's ear canal, for example embodiments where positioner 840 is made from a mold of the user's ear. Elongate support 810 extends transversely through positioner 840.

Figure 8D:
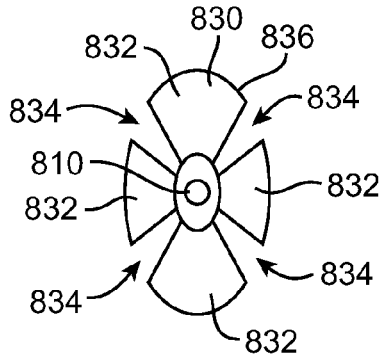
FIG. 8D shows a positioner adapted for placement near the coil assembly, according to embodiments of the present invention.

FIG. 8D shows a positioner adapted for placement near the coil assembly, according to embodiments of the present invention. Positioner 830 includes flanges 832 that extend radially outward to engage the skin of the ear canal. Flanges 832 are formed from a flexible material. Openings 834 are defined by flanges 832. Openings 834 permit sound waves to pass positioner 830 while the positioner is positioned in the ear canal, so that the sound waves are transmitted to the tympanic membrane. Although flanges 832 define an outer boundary of support 830 with an elliptical shape, flanges 832 can comprise an outer boundary with any shape, for example circular. In some embodiments, the positioner has an outer boundary defined by the shape of the individual user's ear canal, for example embodiments where positioner 830 is made from a mold of the user's ear. Elongate support 810 extends transversely through positioner 830.

Although an electromagnetic transducer comprising coil 819 is shown positioned on the end of elongate support 810, the positioner and elongate support can be used with many types of transducers positioned at many locations, for example optical electromagnetic transducers positioned outside the ear canal and coupled to the support to deliver optical energy along the support, for example through at least one optical fiber. The at least one optical fiber may comprise a single optical fiber or a plurality of two or more optical fibers of the support. The plurality of optical fibers may comprise a parallel configuration of optical fibers configured to transmit at least two channels in parallel along the support toward the eardrum of the user.

FIG. 8B-1 shows an elongate support configured to position a distal end of the elongate support with at least one positioners placed in an ear canal. Elongate support 810 and at least one positioner, for example at least one of positioner 830 or positioner 840, or both, are configured to position support 810 in the ear canal with the electromagnetic energy transducer positioned outside the ear canal, and the microphone positioned at least one of in the ear canal or near the ear canal opening so as to detect high frequency spatial localization clues, as described above. For example, the output energy transducer, or emitter, may comprise a light source configured to emit electromagnetic energy comprising optical frequencies, and the light source can be positioned outside the ear canal, for example in a BTE unit. The light source may comprise at least one of an LED or a laser diode, for example. The light source, also referred to as an emitter, can emit visible light, or infrared light, or a combination thereof. The light source can be coupled to the distal end of the support with a waveguide, such as an optical fiber with a distal end of the optical fiber 810D comprising a distal end of the support. The optical energy delivery transducer can be coupled to the proximal portion of the elongate support to transmit optical energy to the distal end. The positioner can be adapted to position the distal end of the support near an eardrum when the proximal portion is placed at a location near an ear canal opening. The intermediate portion of elongate support 810 can be sized to minimize contact with a canal of the ear between the proximal portion to the distal end.

The at least one positioner, for example positioner 830, can improve optical coupling between the light source and a device positioned on the eardrum, so as to increase the efficiency of light energy transfer from the output energy transducer, or emitter, to an optical device positioned on the eardrum. For example, by improving alignment of the distal end 810D of the support that emits light and a transducer positioned at least one of on the eardrum or in the middle ear. The at least one positioner and elongate support 810 comprising an optical fiber can be combined with many known optical transducer and hearing devices, for example as described in U.S. application Ser. No. 11/248,459, entitled "Systems and Methods for Photo-Mechanical Hearing Transduction", the full disclosure of which has been previously incorporated herein by reference, and U.S. Pat. No. 7,289,63, entitled "Hearing Implant", the full disclosure of which is incorporated herein by reference. The positioner and elongate support may also be combined with photo-electro-mechanical transducers positioned on the ear drum with a support, as described in U.S. Pat. Ser. Nos. 61/073,271; and 61/073,281, both filed on Jun. 17, 2008, the full disclosures of which have been previously incorporated herein by reference.

In specific embodiments, elongate support 810 may comprise an optical fiber coupled to positioner 830 to align the distal end of the optical fiber with an output transducer assembly supported on the eardrum. The output transducer assembly may comprise a photodiode configured to receive light transmitted from the distal end of support 810 and supported with support component 30 placed on the eardrum, as described above. The output transducer assembly can be separated from the distal end of the optical fiber, and the proximal end of the optical fiber can be positioned in the BTE unit and coupled to the light source. The output transducer assembly can be similar to the output transducer assembly described in U.S. 2006/0189841, with positioner 830 used to align the optical fiber with the output transducer assembly, and the BTE unit may comprise a housing with the light source positioned therein.

Figure 9A:
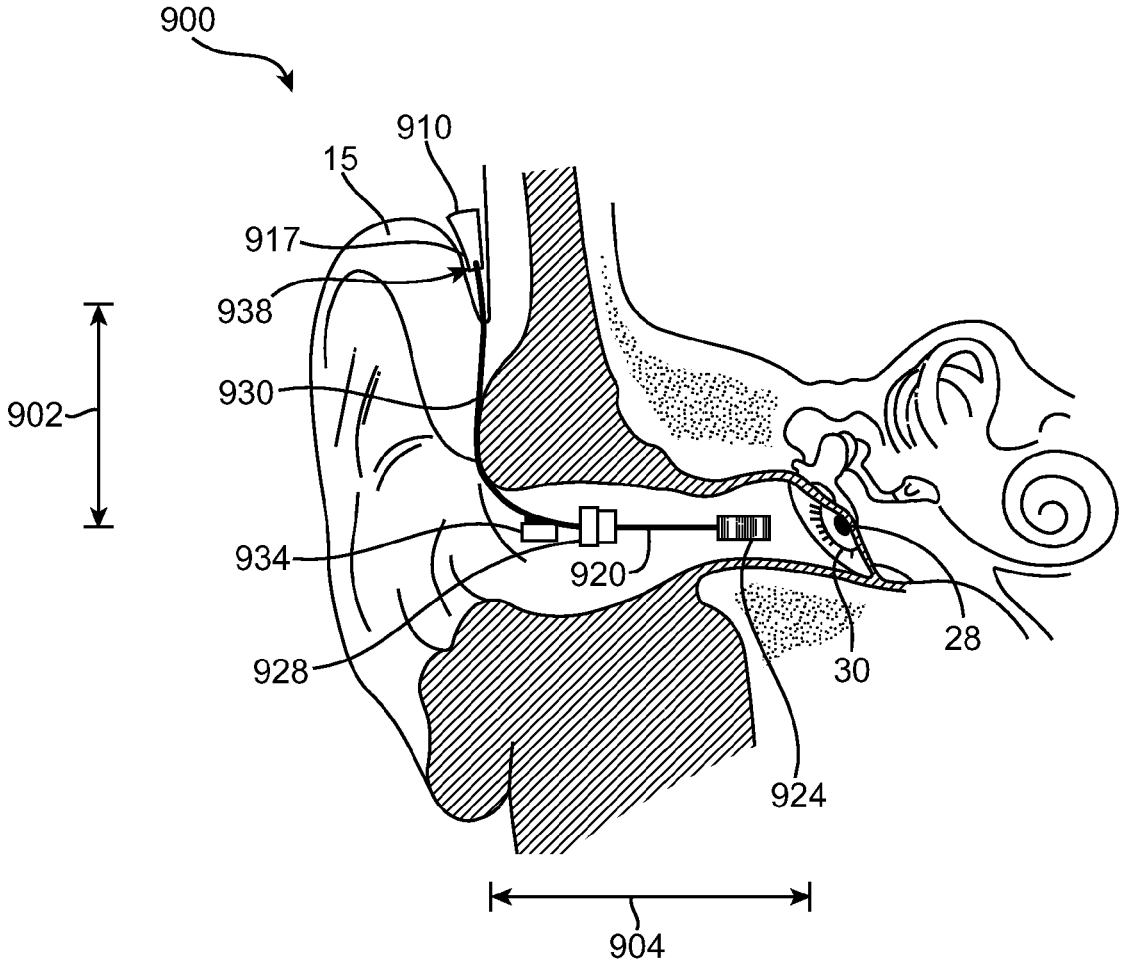
FIG. 9A shows a schematic illustration of a hearing aid device with modular inter-connectable components to customize the device to the dimensions of the user, according to embodiments of the present invention.
Figure 9C:
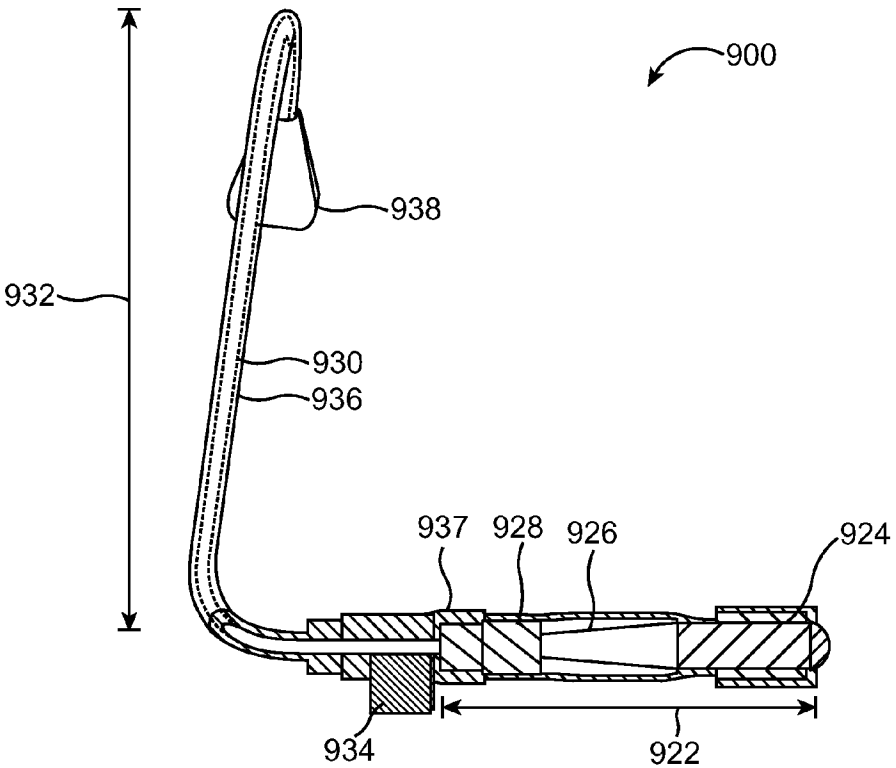
FIG. 9C shows a cross sectional view of the hearing aid device as in FIGS. 9A and 9B, according to embodiments of the present invention.
Figure 9B:
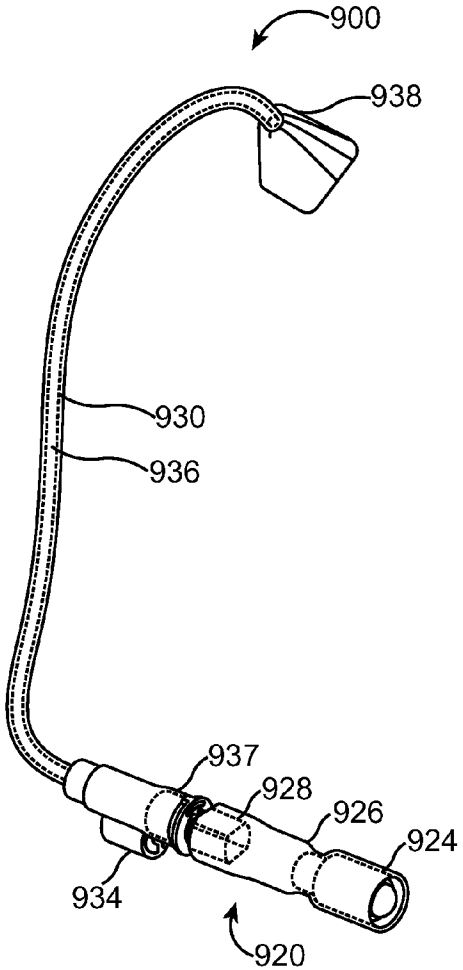
FIG. 9B shows an isometric view of the hearing aid device as in FIG. 9A, according to embodiments of the present invention.

FIGS. 9A, 9B and 9C show a hearing aid device assembly with modular inter-connectable components to customize the device to the dimensions of the user, according to embodiments of the present invention. An assembly 900 of the hearing aid components includes a BTE component 910, an elongate canal component 920 and an elongate pinna component 930. BTE component 910 includes a processor, batteries and additional electronics as described above. A pinna dimension 902 can be determined such that elongate pinna component 930 corresponds to pinna dimension 902. In many embodiments, pinna dimension 902 corresponds to a distance from BTE component 910 to the ear canal opening. An ear canal length 904 corresponds to a distance from the ear canal opening to the eardrum. A connector 928 connects elongate pinna component 930 to elongate ear canal component 920. By providing several sizes of pinna components and several sizes of elongate canal components, several combinations of pinna components and canal components can be obtained from the varying sizes. In some embodiments, five pinna components are provided and five ear canal components are provided such that twenty-five combinations of components can be used to fit the user.

Elongate canal component 920 includes structure to provide patient comfort. A length 922 of elongate canal component 920 can be selected so as to correspond to the ear canal of the patient. A coil assembly 924 can be positioned near the ear canal and is covered with a biocompatible material as described above. Connector 928 is sized to mate the connector on elongate pinna component 930, such that several components can be combined for custom fit to the user. Elongate ear canal component 920 includes a flexible portion 926 disposed between coil assembly 924 and connector 928 such that the elongate ear canal component 920 can flex and bend in response to user movement as described above. Flexible portion 926 includes an inner section that has a hollow conic form to permit movement of the flexible portion.

Elongate pinna component 930 includes several structures to provide patient comfort. A length 932 of elongate pinna component 930 can be selected so as to correspond to the pinna dimension, for example from the BTE unit to the ear opening. A microphone 934 is sized to fit near the ear canal opening, in many embodiments within about 6 mm of the ear canal opening and without contacting the ear of the user. A connector 937 is sized and shaped to mate with connector 928 of the ear canal component such that the combined components have a size customized for the user. Wires 936, in many embodiments 5 wires, extend along the elongate pinna component to send signals from the microphone to the BTE unit and power the coil assembly with processed audio signals. In many embodiments, elongate pinna component 930 comprises an elongate plastic tube disposed over the wires to protect the wires and support the canal component. As least some of wires 936 may be sized to support the canal component and microphone. A connector 938 connects elongate pinna component 930 with BTE unit 910.

Figure 9D:
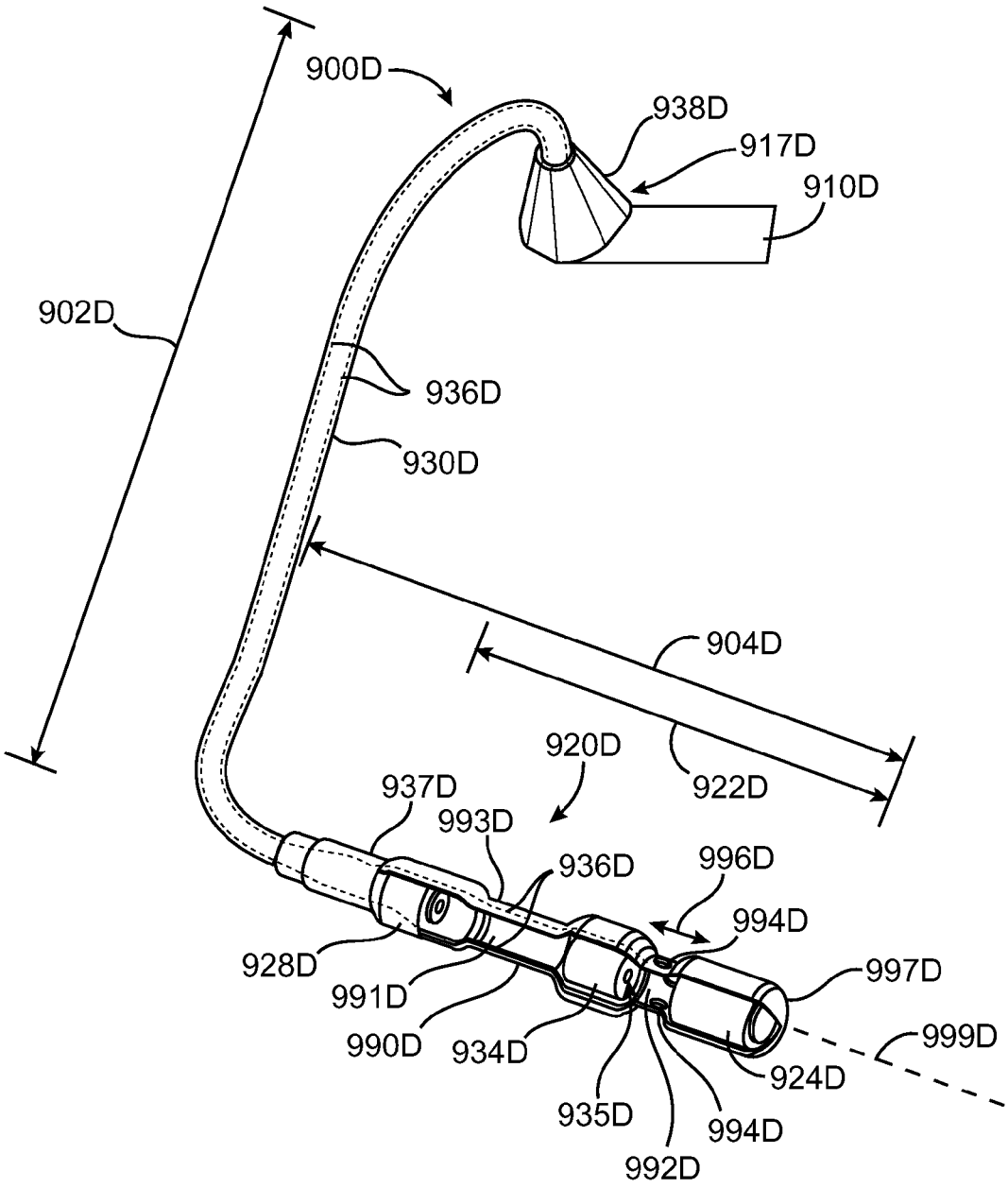
FIG. 9D shows a partial cut away view of hearing aide device with the microphone and coil assembly positioned inside an elongate support comprising a sleeve, according to embodiments of the present invention.

FIG. 9D shows a partial cut away view of a hearing aid device assembly 900D with a microphone 934D and a transducer, for example a coil assembly 924D, positioned inside a flexible support. Device assembly 900D may comprise components of a system that includes a BTE unit and a magnet positioned on the ear, as described above. The flexible support comprises a flexible elongate pinna component 930 and a flexible elongate ear canal component 920D. Flexible elongate ear canal component 920D comprises a flexible sleeve 990D, for example a flexible tube, that defines an enclosure 991D, for example a lumen of the tube. Microphone 934D and coil assembly 924D may be positioned within enclosure 991D defined by flexible sleeve 990D. Microphone 934D and coil assembly 924D can be sized to fit inside enclosure 991D of sleeve 990D and sized to minimize contact with the ear inside the canal. Could assembly 924D may comprise many of the coil assemblies described above, for example coil assemblies adapted to couple to a magnet positioned on the eardrum. Microphone 934D can be positioned lateral to coil assembly 924D along an elongate axis 999D of flexible sleeve 990D. Flexible sleeve 990D may comprise at least one opening, for example multiple openings 994D, for conduction of sound from the ear canal to microphone 934D. Elongate flexible sleeve 990D can extend from a proximal connector 928D to a distal end 997D, and may be sized in cross section so as to minimize contact with the ear canal. In many embodiments, at least an intermediate portion of sleeve 990D between connector 928D and distal end 997D is sized to minimize contact with the ear canal, for example the portion over microphone 934D.

Flexible elongate ear canal component 920D includes structures for patient comfort. For example, flexible elongate ear canal component 920D can include structures, such that the elongate ear canal component 920D can flex and/or bend in response to user movement. In many embodiments, a flexible portion 993D of sleeve 990D is disposed between coil assembly 924D and connector 928D. Flexible portion 993D can include a hollow section of enclosure 991D to permit movement of the flexible portion and elongate canal component 920D in response to patient facial movements including opening and closing of the jaw so as to provide patient comfort. Wires 936D that connect the BTE unit to the coil assembly and/or microphone can also flex at least along the flexible portion of the elongate canal component. End 997D of flexible sleeve 990D can be rounded, such the rounded end 997D can slide along the ear canal when the rounded end contacts the ear inside the canal. Flexure of the elongate canal component, for example with bending of the flexible portion, can also minimize patient discomfort when the rounded end contacts the ear canal and/or slides along the ear canal.

In many embodiments, microphone 934 can be positioned between the coil assembly 924D and the connector 928D to measure sound near the eardrum. In specific embodiments, a microphone port, for example opening 935D, faces the coil assembly 924D. An air gap 992D can be provided in a hollow section of enclosure 991D between the coil assembly 924D and microphone opening 935D. Microphone opening 935D is in acoustic communication with the ear canal so as to receive sound from the ear canal through at least one opening, for example several openings 994D, in sleeve 990D. Air gap 992D may extend a distance 996D of no more than about 12 mm, for example no more than about 6 mm, such that opening 935D and openings 994D are positioned deep in the ear canal so as to receive sound similar to that received by the eardrum. This placement of the microphone and openings near the eardrum can avoid having to measure the gain of sound transfer from the ear canal opening to the eardrum, and thus may avoid having to compensate for this transfer function, which can have practical advantages.

In some embodiments, microphone opening 935D and air gap 992D are protected from invasion by ear canal wax and corrosive substances with known "cerumen guard" methods and/or substances applied to the several port openings 994D.

The embodiments of FIG. 9D may include many of the components and/or modules as described above, for example with reference to FIGS. 9A to 9C. Hearing aid device assembly 900D can include modular inter-connectable components to customize the device to the dimensions of the user, according to embodiments of the present invention. Assembly 900D of the hearing aid components includes a BTE component 910D, elongate canal component 920D and an elongate pinna component 930D. BTE component 910D includes a processor, batteries and additional electronics as described above. A pinna dimension 902D can be determined such that elongate pinna component 930D corresponds to pinna dimension 902D. In many embodiments, pinna dimension 902D corresponds to a distance from BTE component 910D to the ear canal opening. An ear canal length 904D corresponds to a distance from the ear canal opening to the eardrum, as described above. A connector 928D connects elongate pinna component 930D to elongate ear canal component 920D. By providing several sizes of pinna components and several sizes of elongate canal components, several combinations of pinna components and canal components can be obtained from the varying sizes, as described above.

A length 922D of elongate canal component 920D can be selected so as to correspond to the ear canal of the patient, as described above. A coil assembly 924D can be positioned inside the ear canal and is covered with a biocompatible material, as described above. Connector 928D is sized to mate connector 937D on elongate pinna component 930, such that several components can be combined for custom fit to the user, as described above.

Elongate pinna component 930D includes several structures to provide patient comfort similar to those described above. A length 932D of elongate pinna component 930D can be selected so as to correspond to the pinna dimension, for example from the BTE unit to the ear opening. A connector 937D is sized and shaped to mate with connector 928D of the ear canal component such that the combined components have a size customized for the user. Wires 936D, in many embodiments 5 wires, extend along the elongate pinna component to send signals from the microphone to the BTE unit and power the coil assembly with processed audio signals. In many embodiments, elongate pinna component 930D comprises an elongate plastic tube disposed over the wires to protect the wires and support the canal component. As least some of wires 936D may be sized and/or coiled to flex with the canal component and microphone. A connector 938D connects elongate pinna component 930D with BTE unit 910D.

Figure 9E:
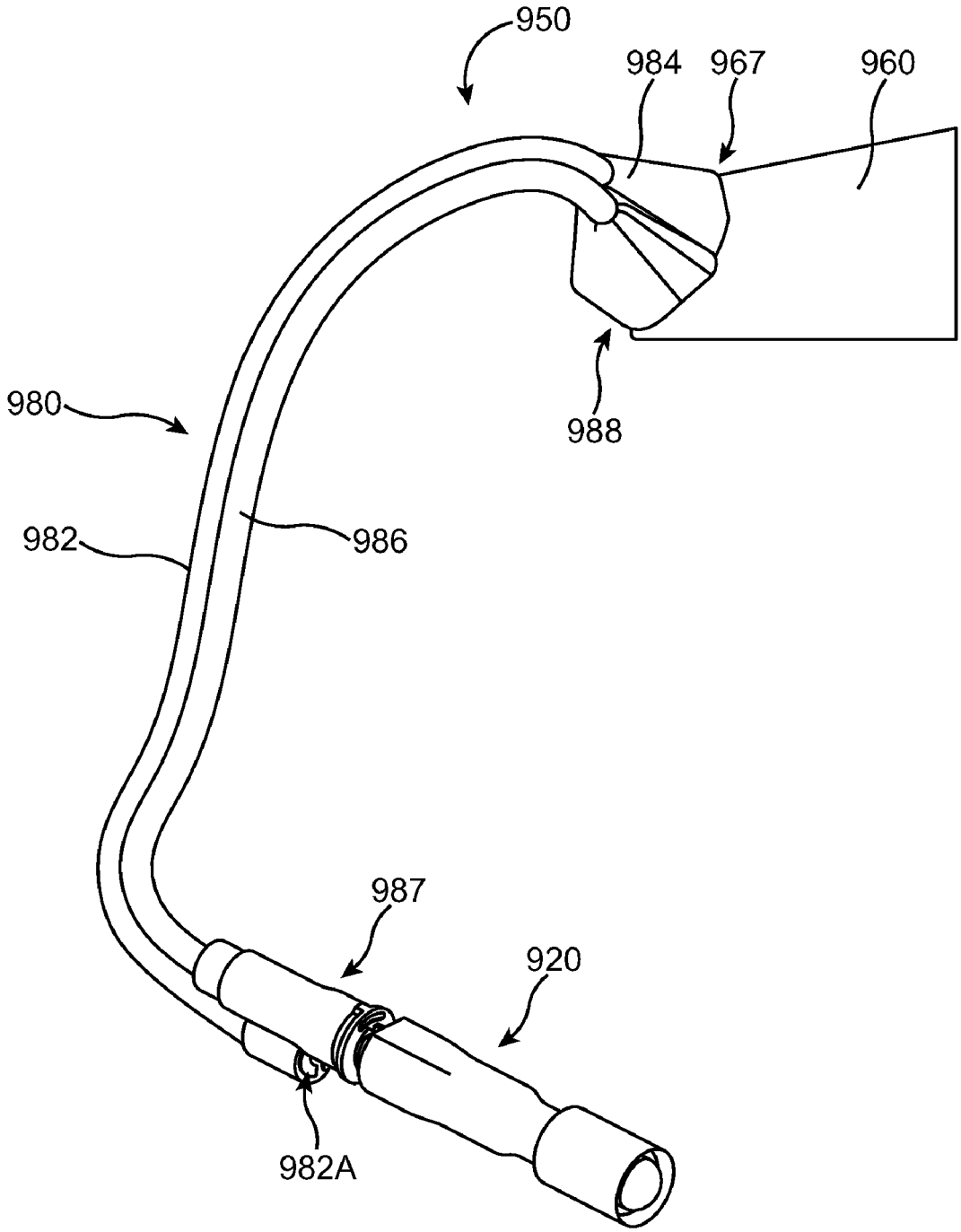
FIG. 9E shows a hearing aid device with a tube along the elongate pinna component to conduct sound from the ear canal opening to a microphone positioned away from the ear canal opening, according to embodiments of the present invention.

FIG. 9E shows a hearing aid device assembly 950 with a tube 982 along the elongate pinna component to conduct sound from the ear canal opening to a microphone positioned away from the ear canal opening, according to embodiments of the present invention. In many embodiments, assembly 950 includes elongate ear canal component 920 as described above. An opening 982A is formed near the end of tube 982 to detect sound near the opening to the ear canal, in many embodiments within about 6 mm of the opening of the ear canal. Sound is conducted along tube 982 from opening 982A toward a microphone 984 near an opposing end of pinna component 980. Pinna component 980 includes a connector 988 to connect to a BTE unit 960. BTE unit 960 includes a connector 967 that mates with connector 988. In some embodiments, microphone 984 may be located in BTE unit 960 and connector 967 and connector 968 may conduct sound to the microphone located in the BTE unit. The elongate ear canal component and elongate pinna component can be selected to match dimensions of the user.

Elongate pinna component 930 and elongate ear canal component 920 may comprise optical waveguides, for example optical fibers, to transmit light to a transducer positioned on the eardrum, as described above. For example, the light source may be positioned on the BTE component, and each of the elongate pinna component and the elongate ear canal component may comprise an optical fiber and an optical coupling to couple light from the BTE component to the distal end of the elongate support.

Figure 10:
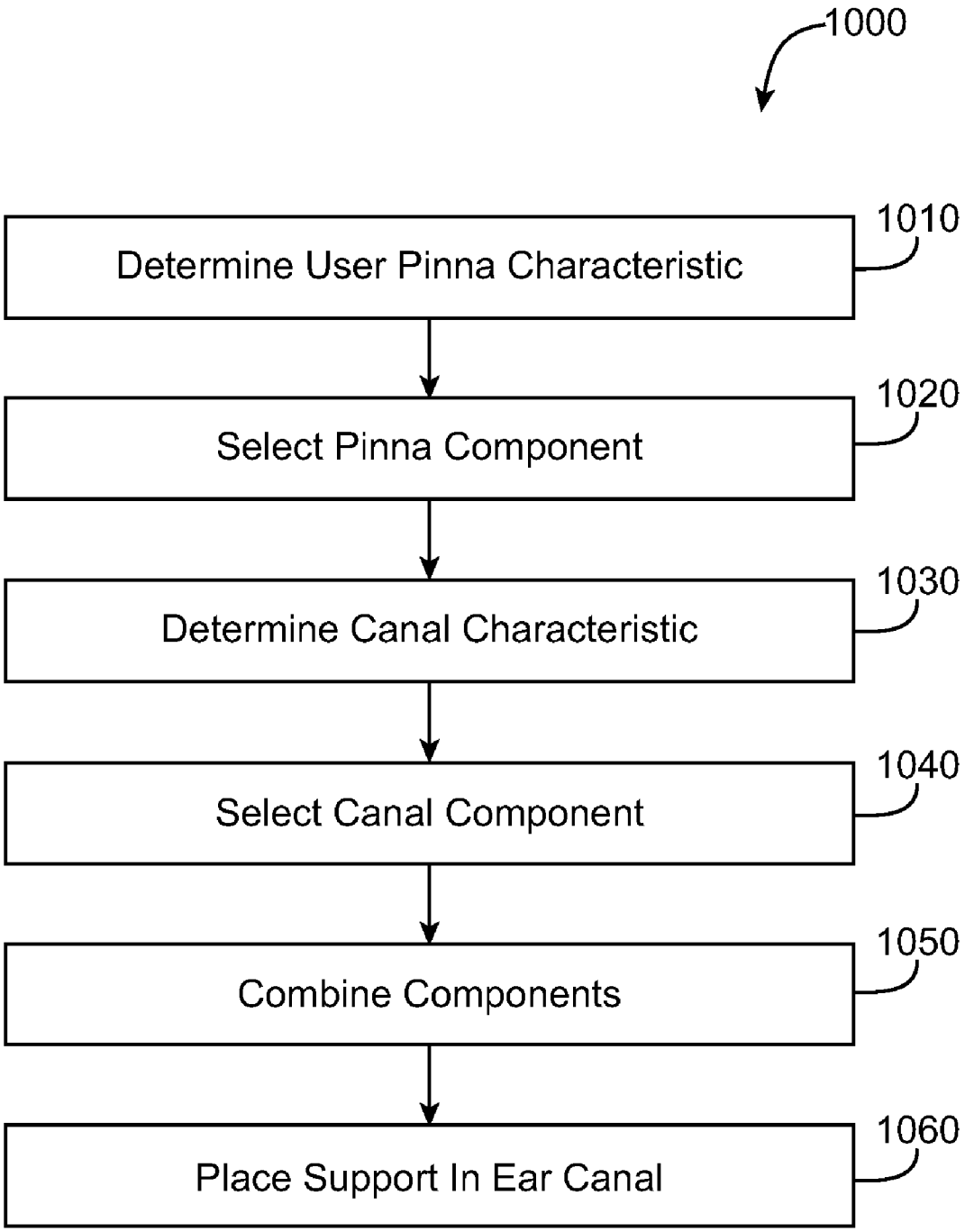
FIG. 10 shows a method of selecting components to fit a user with components as in FIGS. 9A to 9E, according to embodiments of the present invention.

FIG. 10 shows a method 1000 of selecting components to fit a user with components as in FIGS. 9A to 9E, according to embodiments of the present invention. At a step 1010, a user pinna characteristic is determined. In many embodiments, the determined pinna characteristic corresponds to the actual distance measured from the location of the BTE connector to the opening of the ear canal, although the pinna characteristic can be determined in other ways, for example the cross sectional size of the pinna from top to bottom. At a step 1020, a pinna component is selected based on the determined pinna characteristic, for example, one of three available lengths of pinna components can be selected for the user. At a step 1030, a user ear canal component is determined. In many embodiments, the determined ear canal characteristic corresponds to the actual measured length of the ear canal, although the ear canal characteristic can be determined in other ways. In some embodiments, the ear canal characteristic can correspond to the width of the user's head or other anatomy correlated with the user's ear canal length. At a step 1040, an ear canal component is selected based on the determined ear canal characteristic. In some embodiments, one ear canal component is selected from among three available sizes of ear canal components. One of ordinary skill in the art will appreciate that the number of configurations of assembled devices corresponds to the product of available pinna sizes and available ear canal sizes. For example, with three sizes of pinna components available and three sizes of ear canal components available, nine configurations of the device assembly are available to the user. At a step 1050, the components are combined. At a step 1060, the components are placed in the user's ear.

It should be appreciated that the specific steps illustrated in FIG. 10 provide a particular method of fitting a hearing aid device according to an embodiment of the present invention. Other sequences of steps may also be performed according to alternative embodiments. For example, alternative embodiments of the present invention may perform the steps outlined above in a different order. Moreover, the individual steps illustrated in FIG. 10 may include multiple sub-steps that may be performed in various sequences as appropriate to the individual step. Furthermore, additional steps may be added or removed depending on the particular applications. One of ordinary skill in the art would recognize many variations, modifications, and alternatives.

While the exemplary embodiments have been described above in some detail for clarity of understanding and by way of example, a variety of additional modifications, adaptations, and changes may be clear to those of skill in the art. Hence, the scope of the present invention is limited solely by the appended claims.

What is claimed is:

1. A hearing aid device for placement in an ear of a user, the ear having an ear canal opening, an eardrum, a skin of a canal and an ossicle, the device comprising:

an elongate support having a proximal portion for placement at a location near the ear canal opening and a distal end for placement near the eardrum;

an energy delivery transducer attached to the elongate support near the distal end, wherein the energy delivery transducer is adapted to transmit electromagnetic energy across a distance to a vibratory transducer connected to one or more of the eardrum or the ossicle; and a positioner attached to the elongate support near the transducer, the positioner adapted to contact the skin of the canal near the transducer in order to support the transducer;

wherein the support is adapted to position the energy delivery transducer near the eardrum and separated from the vibratory transducer to transmit the electromagnetic energy across the distance while the proximal portion is placed at the location near the ear canal opening and wherein an intermediate portion of the elongate support has a cross-sectional size less than a cross-sectional size of the positioned.

2. The device of claim 1 wherein the intermediate portion extends along at least about 50% of a distance from the proximal portion to the distal end and wherein the distance corresponds to a distance of a canal of the ear.

3. The device of claim 1 wherein the elongate support is adapted to at least partially support the transducer from the proximal portion, has a cross sectional width less than a cross sectional width of the transducer, is adapted to flex in response to user movement for improved comfort, and is adapted to conduct heat from the transducer.

4. The device of claim 1 wherein the positioner has a width sufficient to contact the ear in the canal and support the transducer, and wherein the positioner comprises a flexible portion adapted to bend while the positioner is positioned in the canal.

5. The device of claim 1 wherein the positioner is adapted suspend and center the transducer in the canal to avoid transducer to ear contact, and includes an outer boundary that is oval or circular and adapted to engage the canal while the positioner suspends the transducer in the canal.

6. The device of claim 1 wherein the positioner includes openings formed thereon to pass sound waves through the openings, and the positioner comprises flanges that define the openings.

7. The device of claim 5 wherein the positioner is tapered proximally to facilitate insertion into the canal.

8. The device of claim 1 wherein the positioner comprises a thickness no more than a length of the transducer.

9. The device of claim 1 wherein the transducer has a cross sectional width of no more than about 4 mm.

10. The device of claim 1 wherein the transducer is adapted to transmit electromagnetic energy toward the eardrum to stimulate a magnet suspended on the eardrum and/or an ossicle.

11. The device of claim 10 wherein the transducer comprises a coil comprising a length from about 3 to 6 mm and a width from about 3 to 4 mm and adapted to drive the magnet while a distal end of the coil is positioned a distance from about 2 to 6 mm from the eardrum.

12. The device of claim 1 wherein the electromagnetic energy comprises optical frequencies.

13. The device of claim 1 further comprising a microphone attachable to the support near the proximal portion to position the microphone near the opening to the ear canal.

14. The device of claim 13 wherein the microphone is adapted to generate an electrical signal in response to an audio signal, and further comprising a processor connected to the microphone, the processor adapted to modify the audio signal from the microphone with a transform function and apply the modified audio signal to the transducer to stimulate the ear.

15. The device of claim 14 wherein the processor and a battery to power the processor are adapted to be worn behind a pima of the ear.

16. The device of claim 13 wherein the microphone is attached to the support to position the microphone within about 6 mm of the opening to the canal.

17. The device of claim 13 wherein the elongate support defines an enclosure and wherein a microphone is positioned within the enclosure wherein the elongate support comprises at least one opening and the microphone is configured to measure a sound pressure of the ear canal through the at least one opening.

18. The device of claim 17 wherein the intermediate portion comprises the enclosure and the microphone is positioned within the intermediate portion.

19. The device of claim 17 wherein the elongate support comprises a flexible tube and the enclosure comprises a lumen of the tube.

20. The device of claim 17 wherein the energy delivery transducer comprises a coil positioned within the enclosure, and wherein an opening of the microphone is positioned no more than about 12 mm from a proximal end of the coil to measure a sound pressure of the ear canal near the eardrum.

21. The device of claim 1 further comprising a microphone adapted to be worn behind a pinna of the ear with a probe tube that extends to the ear canal opening, wherein the probe tube has an opening near the ear canal opening such that the microphone detects sound from the ear canal opening.

22. The device of claim 1 wherein the energy delivery transducer is adapted to transmit electromagnetic energy toward the eardrum to stimulate the vibratory transducer suspended on the eardrum and/or an ossicle.

23. The device of claim 22 wherein the vibratory transducer comprises an electromagnetic transducer that vibrates the eardrum, the ossicles, or a cochlea.

* * * * *